US010078987B2

(12) United States Patent
Lee et al.

(10) Patent No.: US 10,078,987 B2
(45) Date of Patent: Sep. 18, 2018

(54) DISPLAY APPARATUS

(71) Applicant: SAMSUNG DISPLAY CO., LTD., Yongin-Si, Gyeonggi-Do (KR)

(72) Inventors: YongSoon Lee, Asan-Si (KR); Sang Hyun Park, Cheonan-Si (KR); Kyungmo Lee, Seoul (KR); Yong-Sik Hwang, Yongin-Si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 143 days.

(21) Appl. No.: 15/164,042

(22) Filed: May 25, 2016

(65) Prior Publication Data

US 2017/0154585 A1 Jun. 1, 2017

(30) Foreign Application Priority Data

Nov. 27, 2015 (KR) ..... 10-2015-0167559

(51) Int. Cl.
*G09G 3/36* (2006.01)
*G09G 3/20* (2006.01)

(52) U.S. Cl.
CPC ..... *G09G 3/36* (2013.01); *G09G 3/2092* (2013.01); *G09G 2310/0289* (2013.01); *G09G 2310/08* (2013.01)

(58) Field of Classification Search
CPC ..... G09G 3/3674–3/3681; G09G 2310/0264–2310/0267; G09G 2310/0289
USPC ..... 345/100; 377/64–81
See application file for complete search history.

(56) References Cited

U.S. PATENT DOCUMENTS

| | | | | |
|---|---|---|---|---|
| 9,318,071 | B2 * | 4/2016 | Won | G09G 3/3677 |
| 9,818,356 | B2 * | 11/2017 | Won | G09G 3/3677 |
| 2007/0296682 | A1 * | 12/2007 | Hwang | G09G 3/3677 345/100 |
| 2008/0218502 | A1 * | 9/2008 | Lee | G09G 3/3674 345/208 |
| 2009/0021502 | A1 * | 1/2009 | Lee | G09G 3/3648 345/205 |
| 2014/0104248 | A1 * | 4/2014 | Won | G09G 5/00 345/204 |
| 2014/0210700 | A1 * | 7/2014 | Won | G09G 3/3677 345/102 |

(Continued)

FOREIGN PATENT DOCUMENTS

KR 1020030005448 1/2003

*Primary Examiner* — Michael Pervan
(74) *Attorney, Agent, or Firm* — F. Chau & Associates, LLC

(57) ABSTRACT

A display apparatus includes a timing controller configured to generate a single clock control signal comprising a plurality of ON-control pulses and a plurality of OFF-control pulses, a gate clock generator configured to generate a plurality of clock signals based on the single clock control signal, ON-periods of the plurality of clock signals starting in response to an ON-control pulse among the ON-control pulses and OFF-periods of the plurality of clock signals starting in response to an OFF-control pulse among the OFF-control pulses, a gate driver comprising a plurality of shift registers which generates a plurality of gate signals based on the plurality of clock signals, and a display panel comprising a display area in which a plurality of pixels is arranged and a peripheral area in which the plurality of shift registers is arranged.

19 Claims, 14 Drawing Sheets

(56) References Cited

U.S. PATENT DOCUMENTS

2014/0347341 A1* 11/2014 Pyun ..... G09G 3/3696
345/212

* cited by examiner

DISPLAY APPARATUS

CROSS-REFERENCE TO RELATED APPLICATION

This application claims priority under 35 U.S.C. § 119 to Korean Patent Application No. 10-2015-0167559, filed on Nov. 27, 2015, the disclosure of which is incorporated by reference in its entirety herein.

BACKGROUND

1. Technical Field

Exemplary embodiments of the inventive concept relate to a display apparatus.

2. Discussion of Related Art

Generally, a liquid crystal display ('LCD') apparatus includes an LCD panel displaying an image using transmissivity of liquid crystal in the LCD panel, and a backlight assembly disposed under the LCD panel to provide light to the LCD panel.

The LCD panel includes a plurality of gate lines, a plurality of data lines and a plurality of pixels. The LCD apparatus further includes a gate driving circuit providing gate signals to the gate lines and a data driving circuit providing data signals to the data lines.

An amorphous silicon gate ('ASG') driver circuit may be used to implement the gate driving circuit, to use less area, improve productivity, and reduce manufacturing costs.

BRIEF SUMMARY

According to an exemplary embodiment of the inventive concept, there is provided a display apparatus. The display apparatus includes a timing controller configured to generate a single clock control signal including a plurality of ON-control pulses and a plurality of OFF-control pulses, a gate clock generator configured to generate a plurality of clock signals based on the single clock control signal, ON-periods of the plurality of clock signals starting in response to an ON-control pulse among the ON-control pulses and OFF-periods of the plurality of clock signals starting in response to an OFF-control pulse among the OFF-control pulses, a gate driver including a plurality of shift registers which generates a plurality of gate signals based on the plurality of clock signals, and a display panel comprising a display area in which a plurality of pixels is arranged and a peripheral area in which the plurality of shift registers is arranged.

In an exemplary embodiment, the plurality of ON-control pulses include a pulse that repeats each time a period (T) has elapsed and the plurality of OFF-control pulses include a pulse that repeats each time the period (T) has elapsed.

In an exemplary embodiment, a first OFF-control pulse of the plurality of OFF-control pulses has a first delay difference from a first ON-control pulse of the plurality of ON-control pulses, and the first delay difference is greater than the period (1T) and less than twice the period (2T).

In an exemplary embodiment, the clock signals include a first clock signal, a second clock signal which is delayed by the period (1T) from the first clock signal, a third clock signal which is delayed the period (1T) from the second clock signal and a fourth clock signal which is delayed by the period (1T) from the third clock signal.

In an exemplary embodiment, the first clock signal is applied to a (1+4K)-th shift register (K is a natural number as 0, 1, 2, 3, . . . ), the (1+4K)-th shift register is configured to output a (1+4K)-th gate signal synchronized with an ON-period of the first clock signal, the second clock signal is applied to a (2+4K)-th shift register, the (2+4K)-th shift register is configured to output a (2+4K)-th gate signal synchronized with an ON-period of the second clock signal, the third clock signal is applied to a (3+4K)-th shift register, the (3+4K)-th shift register may be configured to output a (3+4K)-th gate signal synchronized with an ON-period of the third clock signal, the fourth clock signal is applied to a (4+4K)-th shift register, and the (4+4K)-th shift register is configured to output a (4+4K)-th gate signal synchronized with an ON-period of the fourth clock signal.

In an exemplary embodiment, a first OFF-control pulse of the plurality of OFF-control pulses has a second delay difference from a first ON-control pulse of the plurality of ON-control pulses, and the second delay difference is greater than three times the period (3T) and less than four times the period (4T).

In an exemplary embodiment, the clock signal include a first clock signal, a second clock signal which is delayed by the period (1T) from the first clock signal, a third clock signal which is delayed by the period (1T) from the second clock signal, a fourth clock signal which is delayed by the period (1T) from the third clock signal, a fifth clock signal which is delayed by the period (1T) from the fourth clock signal and a sixth clock signal which is delayed by the period (1T) from the fifth clock signal.

In an exemplary embodiment, the first clock signal is applied to a (1+6K)-th shift register (K is a natural number as 0, 1, 2, 3, . . . ), the (1+6K)-th shift register is configured to output a (1+6K)-th gate signal synchronized with an ON-period of the first clock signal, the second clock signal is applied to a (2+6K)-th shift register, the (2+6K)-th shift register is configured to output a (2+6K)-th gate signal synchronized with an ON-period of the second clock signal, the third clock signal is applied to a (3+6K)-th shift register, the (3+6K)-th shift register is configured to output a (3+6K)-th gate signal synchronized with an ON-period of the third clock signal, the fourth clock signal is applied to a (4+6K)-th shift register, the (4+6K)-th shift register is configured to output a (4+6K)-th gate signal synchronized with an ON-period of the fourth clock signal, the fifth clock signal is applied to a (5+6K)-th shift register, the (5+6K)-th shift register is configured to output a (5+6K)-th gate signal synchronized with an ON-period of the fifth clock signal, the sixth clock signal is applied to a (6+6K)-th shift register, and the (6+6K)-th shift register is configured to output a (6+6K)-th gate signal synchronized with an ON-period of the sixth clock signal.

In an exemplary embodiment, a first OFF-control pulse of the plurality of OFF-control pulses has a third delay difference from a first ON-control pulse of the plurality of ON-control pulses, and the third delay difference is greater than four times the period (4T) and less than five times the period (5T).

In an exemplary embodiment, the clock signals include a first clock signal, a second clock signal which is delayed by the period (1T) from the first clock signal, a third clock signal which is delayed by the period (1T) from the second clock signal, a fourth clock signal which is delayed by the period (1T) from the third clock signal, a fifth clock signal which is delayed by the period (1T) from the fourth clock signal, a sixth clock signal which is delayed by the period (1T) from the fifth clock signal, a seventh clock signal which is delayed by the period (1T) from the sixth clock signal and an eighth clock signal which is delayed by the period (1T) from the seventh clock signal.

In an exemplary embodiment, the first clock signal is applied to a (1+8K)-th shift register (K is a natural number as 0, 1, 2, 3, . . . ), the (1+8K)-th shift register may be configured to output a (1+8K)-th gate signal synchronized with an ON-period of the first clock signal, the second clock signal is applied to a (2+8K)-th shift register, the (2+8K)-th shift register is configured to output a (2+8K)-th gate signal synchronized with an ON-period of the second clock signal, the third clock signal is applied to a (3+8K)-th shift register, the (3+8K)-th shift register is configured to output a (3+8K)-th gate signal synchronized with an ON-period of the third clock signal, the fourth clock signal is applied to a (4+8K)-th shift register, the (4+8K)-th shift register is configured to output a (4+8K)-th gate signal synchronized with an ON-period of the fourth clock signal, the fifth clock signal is applied to a (5+8K)-th shift register, the (5+8K)-th shift register is configured to output a (5+8K)-th gate signal synchronized with an ON-period of the fifth clock signal, the sixth clock signal is applied to a (6+8K)-th shift register, the (6+8K)-th shift register is configured to output a (6+8K)-th gate signal synchronized with an ON-period of the sixth clock signal, the seventh clock signal is applied to a (7+8K)-th shift register, the (7+8K)-th shift register is configured to output a (7+8K)-th gate signal synchronized with an ON-period of the sixth clock signal, the eighth clock signal is applied to a (8+8K)-th shift register, and the (8+8K)-th shift register is configured to output a (8+8K)-th gate signal synchronized with an ON-period of the sixth clock signal.

In an exemplary embodiment, an m-th shift register of the plurality of shift registers includes a pull-up part configured to output a high voltage of a first clock signal as a high voltage of an m-th gate signal, a control pull-down part configured to discharge a control node of the pull-up part in response to an (m+1)-th gate signal, a first control holding part configured to hold the control node of the pull-up part to a low voltage in response to a high voltage of a second clock signal having a phase opposite to a phase of the first clock signal, and a second control holding part configured to hold an output node of the pull-up part to a low voltage in response to a high voltage of the second clock signal.

According to an exemplary embodiment of the inventive concept, there is provided a display apparatus. The display apparatus includes a timing controller configured to generate a first clock control signal comprising a plurality of ON-control pulses and a second clock control signal comprising a plurality of OFF-control pulses, a gate clock generator configured to generate a plurality of clock signals based on the first clock control signal and the second clock control signal, ON-periods of the plurality of clock signals starting in response to an ON-control pulse and OFF-periods of the plurality of clock signals starting in response to an OFF-control pulse, a gate driver comprising a plurality of shift registers which generates a plurality of gate signals based on the plurality of clock signals, and a display panel comprising a display area in which a plurality of pixels is arranged and a peripheral area in which the plurality of shift registers is arranged.

In an exemplary embodiment, the plurality of ON-control pulses include a pulse that repeats each time a period (T) has elapsed, the plurality of OFF-control pulses include a pulse that repeats each time the period (T) has elapsed, a first OFF-control pulse of the plurality of OFF-control pulses may have a first delay difference from a first ON-control pulse of the plurality of ON-control pulses, and the first delay difference is greater than the period (1T) and less than twice the period (2T).

In an exemplary embodiment, the first clock signal is applied to a (1+4K)-th shift register (K is a natural number as 0, 1, 2, 3, . . . ), the (1+4K)-th shift register is configured to output a (1+4K)-th gate signal synchronized with an ON-period of the first clock signal, the second clock signal may be applied to a (2+4K)-th shift register, the (2+4K)-th shift register is configured to output a (2+4K)-th gate signal synchronized with an ON-period of the second clock signal, the third clock signal is applied to a (3+4K)-th shift register, the (3+4K)-th shift register is configured to output a (3+4K)-th gate signal synchronized with an ON-period of the third clock signal, the fourth clock signal is applied to a (4+4K)-th shift register, and the (4+4K)-th shift register is configured to output a (4+4K)-th gate signal synchronized with an ON-period of the fourth clock signal.

In an exemplary embodiment, the plurality of ON-control pulses include a pulse that repeats each time a period (T) has elapsed, the plurality of OFF-control pulses include a pulse that repeats each time the period (T) has elapsed, a first OFF-control pulse of the plurality of OFF-control pulses have a second delay difference from a first ON-control pulse of the plurality of ON-control pulses, and the second delay difference is greater than three time the period (3T) and less than four times the period (4T).

In an exemplary embodiment, the clock signal include a first clock signal, a second clock signal which is delayed by the period (1T) from the first clock signal, a third clock signal which is delayed by the period (1T) from the second clock signal, a fourth clock signal which is delayed by the period (1T) from the third clock signal, a fifth clock signal which is delayed by one period (1T) from the fourth clock signal and a sixth clock signal which is delayed by the period (1T) from the fifth clock signal, wherein the first clock signal is applied to a (1+6K)-th shift register (K is a natural number as 0, 1, 2, 3, . . . ), the (1+6K)-th shift register is configured to output a (1+6K)-th gate signal synchronized with an ON-period of the first clock signal, the second clock signal is applied to a (2+6K)-th shift register, the (2+6K)-th shift register is configured to output a (2+6K)-th gate signal synchronized with an ON-period of the second clock signal, the third clock signal is applied to a (3+6K)-th shift register, the (3+6K)-th shift register is configured to output a (3+6K)-th gate signal synchronized with an ON-period of the third clock signal, the fourth clock signal is applied to a (4+6K)-th shift register, the (4+6K)-th shift register is configured to output a (4+6K)-th gate signal synchronized with an ON-period of the fourth clock signal, the fifth clock signal is applied to a (5+6K)-th shift register, the (5+6K)-th shift register is configured to output a (5+6K)-th gate signal synchronized with an ON-period of the fifth clock signal, the sixth clock signal is applied to a (6+6K)-th shift register, and the (6+6K)-th shift register is configured to output a (6+6K)-th gate signal synchronized with an ON-period of the sixth clock signal.

In an exemplary embodiment, the plurality of ON-control pulses include a pulse that repeats each time a period (T) has elapsed, the plurality of OFF-control pulses include a pulse that repeats each time the period (T) has elapsed, a first OFF-control pulse of the plurality of OFF-control pulses has a third delay difference from a first ON-control pulse of the plurality of ON-control pulses, and the third delay difference is greater than four times the period (4T) and less than five times the period (5T).

In an exemplary embodiment, the clock signals include a first clock signal, a second clock signal which is delayed by the period (1T) from the first clock signal, a third clock signal which is delayed by the period (1T) from the second clock signal, a fourth clock signal which is delayed by the period (1T) from the third clock signal, a fifth clock signal which is delayed by the period (1T) from the fourth clock signal, a sixth clock signal which is delayed by the period (1T) from the fifth clock signal, a seventh clock signal which is delayed by the period (1T) from the sixth clock signal and an eighth clock signal which is delayed by the period (1T) from the seventh clock signal, wherein the first clock signal is applied to a (1+8K)-th shift register (K is a natural number as 0, 1, 2, 3, . . . ), the (1+8K)-th shift register is configured to output a (1+8K)-th gate signal synchronized with an ON-period of the first clock signal, the second clock signal may be applied to a (2+8K)-th shift register, the (2+8K)-th shift register is configured to output a (2+8K)-th gate signal synchronized with an ON-period of the second clock signal, the third clock signal may be applied to a (3+8K)-th shift register, the (3+8K)-th shift register is configured to output a (3+8K)-th gate signal synchronized with an ON-period of the third clock signal, the fourth clock signal is applied to a (4+8K)-th shift register, the (4+8K)-th shift register is configured to output a (4+8K)-th gate signal synchronized with an ON-period of the fourth clock signal, the fifth clock signal is applied to a (5+8K)-th shift register, the (5+8K)-th shift register is configured to output a (5+8K)-th gate signal synchronized with an ON-period of the fifth clock signal, the sixth clock signal is applied to a (6+8K)-th shift register, the (6+8K)-th shift register is configured to output a (6+8K)-th gate signal synchronized with an ON-period of the sixth clock signal, the seventh clock signal is applied to a (7+8K)-th shift register, the (7+8K)-th shift register is configured to output a (7+8K)-th gate signal synchronized with an ON-period of the sixth clock signal, the eighth clock signal is applied to a (8+8K)-th shift register, and the (8+8K)-th shift register is configured to output a (8+8K)-th gate signal synchronized with an ON-period of the sixth clock signal.

In an exemplary embodiment, an m-th shift register of the plurality of shift registers includes a pull-up part configured to output a high voltage of a first clock signal as a high voltage of an m-th gate signal, a control pull-down part configured to discharge a control node of the pull-up part in response to an (m+1)-th gate signal, a first control holding part configured to hold the control node of the pull-up part to a low voltage in response to a high voltage of a second clock signal having a phase opposite to a phase of the first clock signal, and a second control holding part configured to hold an output node of the pull-up part to a low voltage in response to a high voltage of the second clock signal.

According to at least one embodiment of the inventive concept, four or more clock signals may be generated based on one or two clock control signals. Therefore, a number of pins transmitting signals from the timing controller to the gate clock generator may be decreased.

BRIEF DESCRIPTION OF THE DRAWINGS

The inventive concept will become more apparent by describing detailed exemplary embodiments thereof with reference to the accompanying drawings, in which.

DETAILED DESCRIPTION

Hereinafter, exemplary embodiments of the inventive concept will be explained in detail with reference to the accompanying drawings. However, the present inventive concept may be embodied in various different ways and should not be construed as limited to the exemplary embodiments described herein. As used herein, the singular forms, "a," "an" and "the" are intended to include the plural forms as well, unless the context clearly indicates otherwise.

Figure 1:
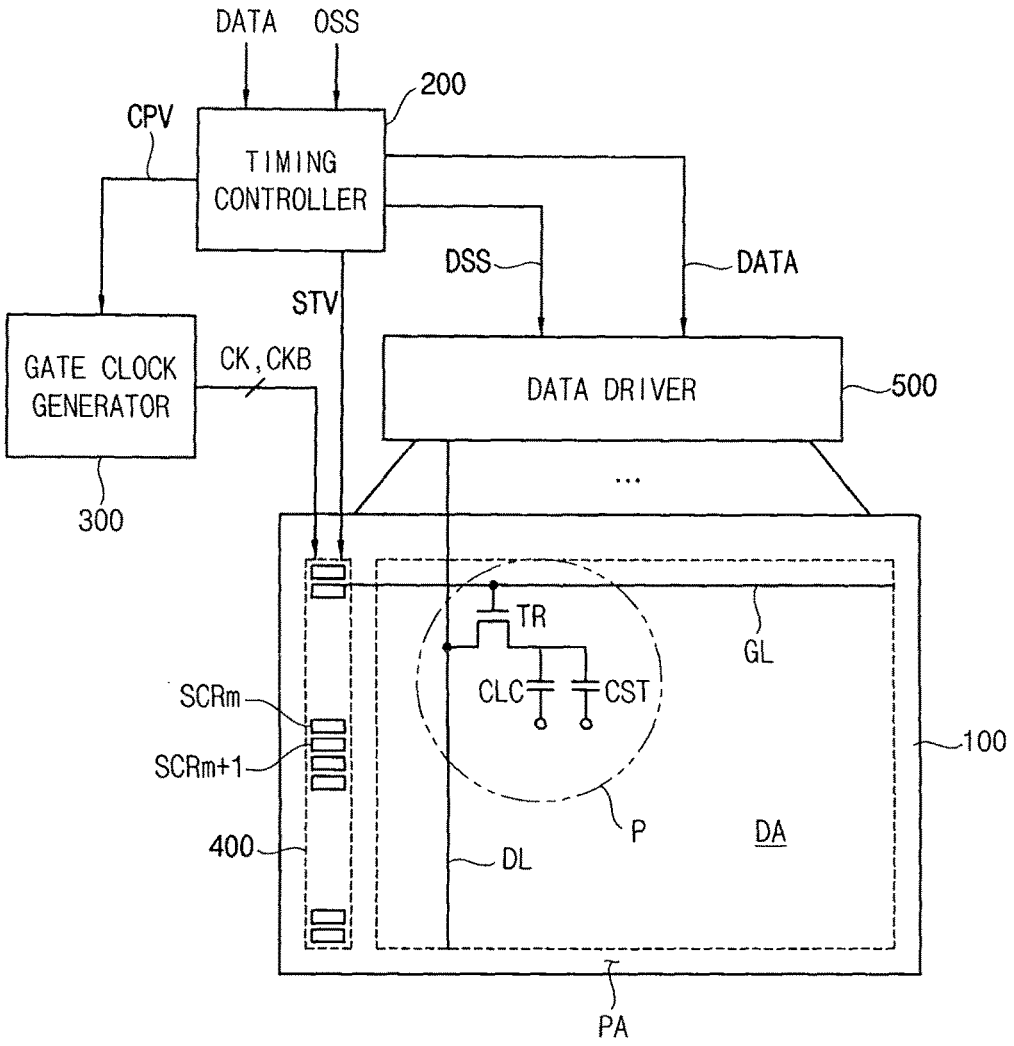
FIG. 1 is a block diagram illustrating a display apparatus according to an exemplary embodiment of the inventive concept.

FIG. 1 is a block diagram illustrating a display apparatus according to an exemplary embodiment of the inventive concept.

Referring to FIG. 1, the display apparatus includes a display panel 100, a timing controller 200, a gate clock generator 300, a gate driver 400 (e.g., a gate driving circuit) and a data driver 500 (e.g., a data driving circuit).

The display panel 100 includes a display area DA and a peripheral area PA surrounding the display area DA. A plurality of gate lines GL, a plurality of data lines DL and a plurality of pixels P are disposed in the display area DA. Each of the plurality of pixels P may include a switching element TR which is connected to a gate line GL and a data line DL, a liquid crystal capacitor CLC which is connected to the switching element TR, and a storage capacitor CST which is connected to the liquid crystal capacitor CLC.

The timing controller 200 is configured to generally control an operation of the display apparatus. The timing controller 200 is configured to receive an image signal DATA and an original synchronization signal OSS. The image signal DATA may include color data such red, green, and blue image data.

The timing controller 200 is configured to generate a display synchronization signal for driving the display apparatus based on the original synchronization signal OSS. The display synchronization signal may include a gate synchronization signal for controlling the gate driver 400 and a data synchronization signal DSS for controlling the data driver 500.

The gate synchronization signal may include a vertical start signal STV and a clock control signal CPV. The data synchronization signal DSS may include a data enable signal, a horizontal synchronization signal, a vertical synchronization signal, and a pixel clock signal.

The gate clock generator 300 is configured to generate a plurality of clock signals CK and CKB for generating a gate signal that is an output signal of the gate driver 400 based on the clock control signal CPV. The clock control signal CPV may include a plurality of ON-control pulses and a plurality of OFF-control pulses. The plurality of ON-control pulses controls an ON-period of the plurality of clock signals and the plurality of OFF-control pulses controls an OFF-period of the plurality of clock signals.

The gate driver 400 may include a plurality of shift registers SCRm and SCRm+1 ('m' is a natural number) which are configured to sequentially generate a plurality of gate signals synchronized with ON-periods of the plurality of clock signals CK and CKB. The shift registers SCRm and SCRm+1 are integrated in the peripheral area PA corresponding to ends of the gate lines. For example, the shift registers are located in the peripheral area PA between an edge of the display panel 100 and the display area DA.

The data driver 500 is configured to convert the image signal DATA to data voltages and to output the data voltages to the data lines DL based on the data synchronization signal DSS.

Figure 2:
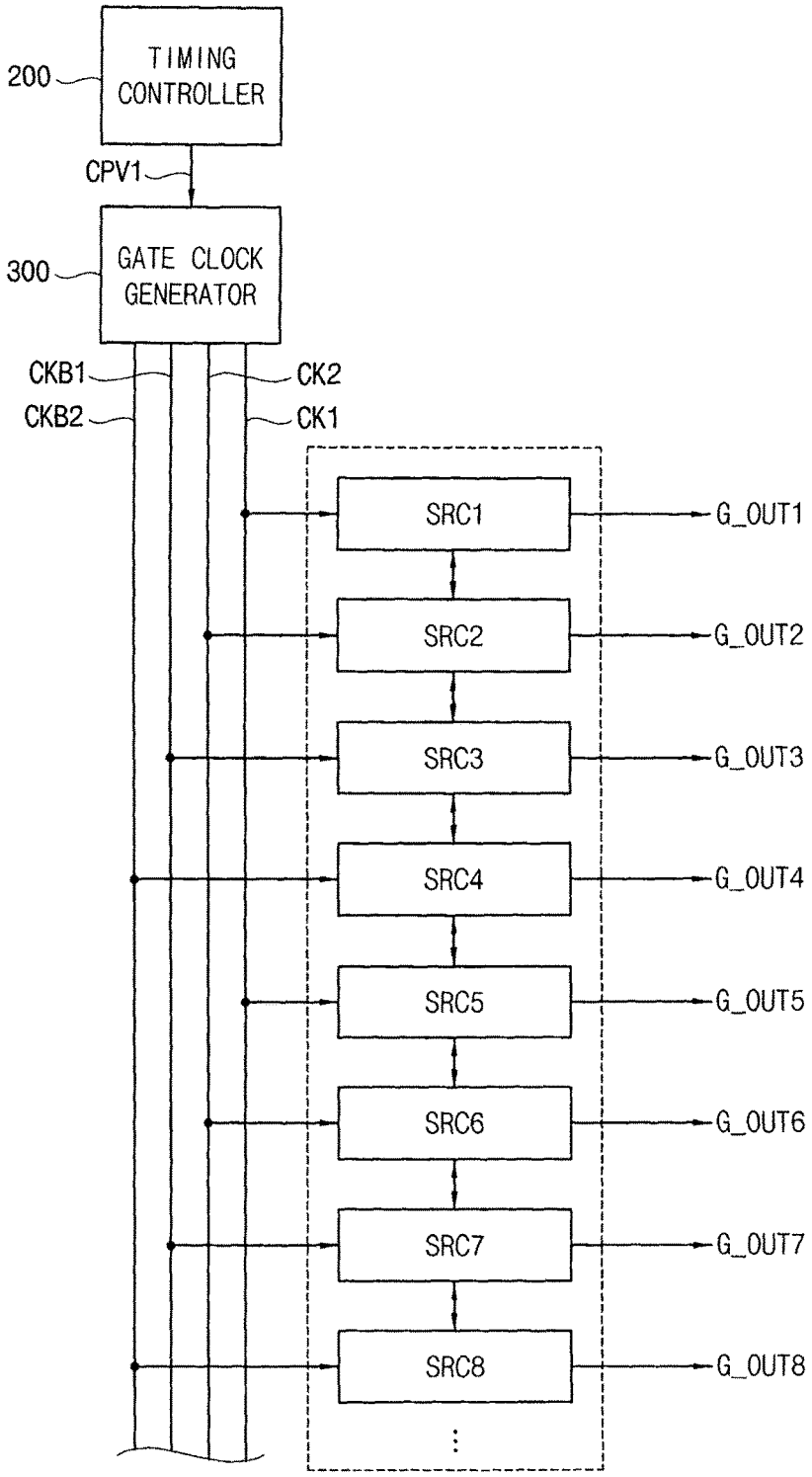
FIG. 2 is a block diagram illustrating a gate driver according to an exemplary embodiment of the inventive concept.
Figure 3:
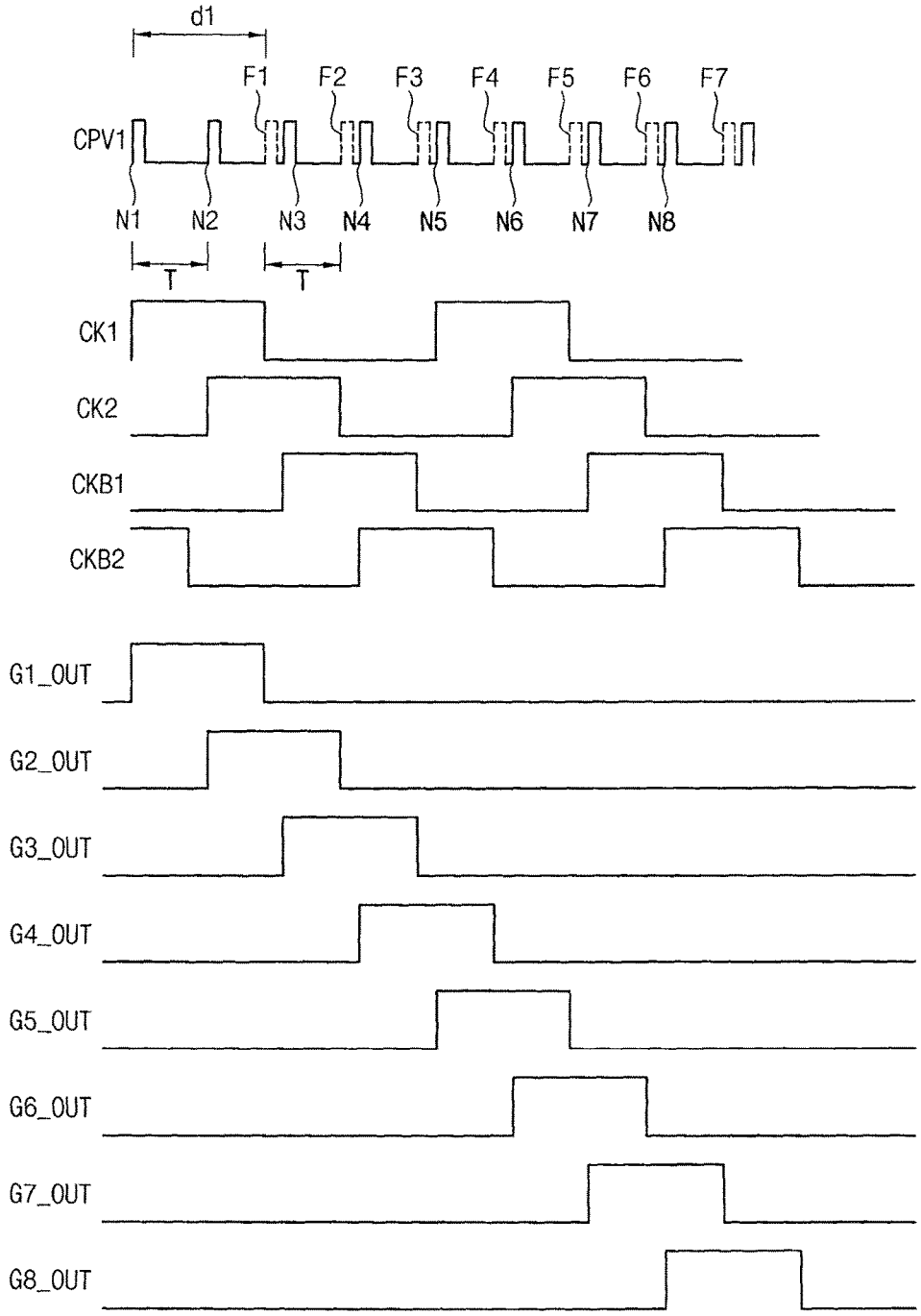
FIG. 3 is a waveform diagram illustrating a driving signal for the gate driver of FIG. 2 according to an exemplary embodiment of the inventive concept.

FIG. 2 is a block diagram illustrating a gate driver according to an exemplary embodiment of the inventive concept. FIG. 3 is a waveform diagram illustrating a driving signal for the gate driver of FIG. 2 according to an exemplary embodiment of the inventive concept.

Referring to FIGS. 2 and 3, the timing controller 200 is configured to output a single clock control signal CPV1. The gate clock generator 300 is configured to generate a plurality of clock signals based on the clock control signal CPV1.

According to the exemplary embodiment, the gate clock generator 300 is configured to generate a first clock signal CK1, a second clock signal CK2, a third clock signal CKB1 and a fourth clock signal CKB2 based on the clock control signal CPV1.

For example, the clock control signal CPV1 may include a plurality of ON-control pulses N1, N2, N3, . . . , N8 and a plurality of OFF-control pulses F1, F2, F3, . . . , F7.

The plurality of ON-control pulses N1, N2, N3, . . . , N8 includes a pulse that repeats each time a first period T has elapsed and the plurality of OFF-control pulses F1, F2, F3, . . . , F7 also includes a pulse that repeats each time the first period T has elapsed.

A first OFF-control pulse F1 is located between a second ON-control pulse N2 and a third ON-control pulse N3 and is delayed by a first delay difference d1 from a first ON-control pulse N1. In an embodiment, the first delay difference is greater than one period (1T) and less than two periods (2T).

An ON-period of the first clock signal CK1 starts in response to the first ON-control pulse N1, and an OFF-period of the first clock signal CK1 starts in response to the first OFF-control pulse F1. Then, the ON-period of the first clock signal CK1 starts in response to a fifth ON-control pulse N5, and the OFF-period of the first clock signal CK1 starts in response to a fifth OFF-control pulse F5. As described above, ON-periods of the first clock signal CK1 sequentially start in response to (1+4K)-th ON-control pulses N1 and N5, and OFF-periods of the first clock signal CK1 sequentially start in response to (1+4K)-th OFF-control pulses F1 and F5 ('K' is a natural number as 0, 1, 2, 3, . . . ).

The first clock signal CK1 is applied to (1+4K)-th shift registers SRC1 and SRC5 and controls ON-periods of (1+4K)-th gate signals G1_OUT and G5_OUT generated from the (1+4K)-th shift registers SRC1 and SRC5. The (1+4K)-th gate signals G1_OUT and G5_OUT are synchronized with the ON-periods of the first clock signal CK1.

An ON-period of the second clock signal CK2 starts in response to the second ON-control pulse N2 and an OFF-period of the second clock signal CK2 starts in response to a second OFF-control pulse F2. Then, the ON-period of the second clock signal CK2 starts in response to a sixth ON-control pulse N6 and the OFF-period of the second clock signal CK2 starts in response to a sixth OFF-control pulse F6. As described above, ON-periods of the second clock signal CK2 sequentially start in response to (2+4K)-th ON-control pulses N2 and N6, and OFF-periods of the second clock signal CK2 sequentially start in response to (2+4K)-th OFF-control pulses F2 and F6 ('K' is a natural number as 0, 1, 2, 3, . . . ).

The second clock signal CK2 is applied to (2+4K)-th shift registers SRC2 and SRC6 and controls ON-periods of (2+4K)-th gate signals G2_OUT and G6_OUT generated from the (2+4K)-th shift registers SRC2 and SRC6. The (2+4K)-th gate signals G2_OUT and G6_OUT are synchronized with the ON-periods of the second clock signal CK2.

An ON-period of the third clock signal CKB1 starts in response to a third ON-control pulse N3 and an OFF-period of the third clock signal CKB1 starts in response to a third OFF-control pulse F3. Then, the ON-period of the third clock signal CKB1 starts in response to a seventh ON-control pulse N7 and the OFF-period of the third clock signal CKB1 starts in response to a seventh OFF-control pulse F7. As described above, ON-periods of the third clock signal CKB1 sequentially start in response to (3+4K)-th ON-control pulses N3 and N7, and OFF-periods of the third clock signal CKB1 sequentially start in response to (3+4K)-th OFF-control pulses F3 and F7 ('K' is a natural number as 0, 1, 2, 3, . . . ).

The ON-period of the third clock signal CKB1 may correspond to the OFF-period of the first clock signal CK1, and the OFF-period of the third clock signal CKB1 may correspond to the OFF-period of the first clock signal CK1. For example, in an embodiment, the ON-period of the third clock signal CKB1 occurs during the OFF-period of the first clock signal CK1.

The third clock signal CKB1 is applied to (3+4K)-th shift registers SRC3 and SRC7, and ON-periods of (3+4K)-th gate signals G3_OUT and G7_OUT generated from the (3+4K)-th shift registers SRC3 and SRC7. The (3+4K)-th gate signals G3_OUT and G7_OUT are synchronized with the ON-periods of the third clock signal CKB1.

An ON-period of the fourth clock signal CKB2 starts in response to a fourth ON-control pulse N4 and an OFF-period of the fourth clock signal CKB2 starts in response to a fourth OFF-control pulse F4. Then, the ON-period of the fourth clock signal CKB2 starts in response to an eighth ON-control pulse N8 and the OFF-period of the fourth clock signal CKB2 starts in response to an eighth OFF-control pulse F8. As describe above, ON-periods of the fourth clock signal CKB2 sequentially start in response to (4+4K)-th ON-control pulse N4 and N8, and OFF-periods of the fourth clock signal CKB2 sequentially start in response to (4+4K)-th OFF-control pulse F4 and F8 ('K' is a natural number as 0, 1, 2, 3, . . . ).

The ON-period of the fourth clock signal CKB2 may correspond to the OFF-period of the second clock signal CK2 and the OFF-period of the fourth clock signal CKB2 may correspond to the ON-period of the second clock signal CK2. For example, in an embodiment, the ON-period of the fourth clock signal CKB2 occurs during the OFF-period of the second clock signal CK2, and part of the OFF-period of the fourth clock signal CKB2 occurs during the ON-period of the second clock signal CK2.

The fourth clock signal CKB2 is applied to (4+4K)-th shift registers SRC4 and SRC8 and controls ON-periods of (4+4K)-th gate signals G4_OUT and G8_OUT generated from the (4+4K)-th shift registers SRC4 and SRC8. The (4+4K)-th gate signals G4_OUT and G8_OUT are synchronized with the ON-periods of the fourth clock signal CKB2.

According to an exemplary embodiment, four clock signals CK1, CK2, CKB1 and CKB2 are generated based on the single clock control signal CPV1. Therefore, a number of pins transmitting signals from the timing controller 200 to the gate clock generator 300 may be decreased. For example, if the four clock signals CK1, CK2, CKB1 and CKB2 are not generated from the single clock control signal CPV1, then they could be transmitted from four respective output pins of the timing controller 200 to four respective input pins of the gate clock generator 300. However, since the gate clock generator 300 can generate the four clock signals CK1, CK2, CKB1 and CKB2 from the single clock control signal CPV1, the timing controller 200 needs only a single output pin to transmit the single clock control signal CPV1 and the gate clock generator 300 needs only a single input pin to receive the single clock control signal CPV1.

Figure 4:
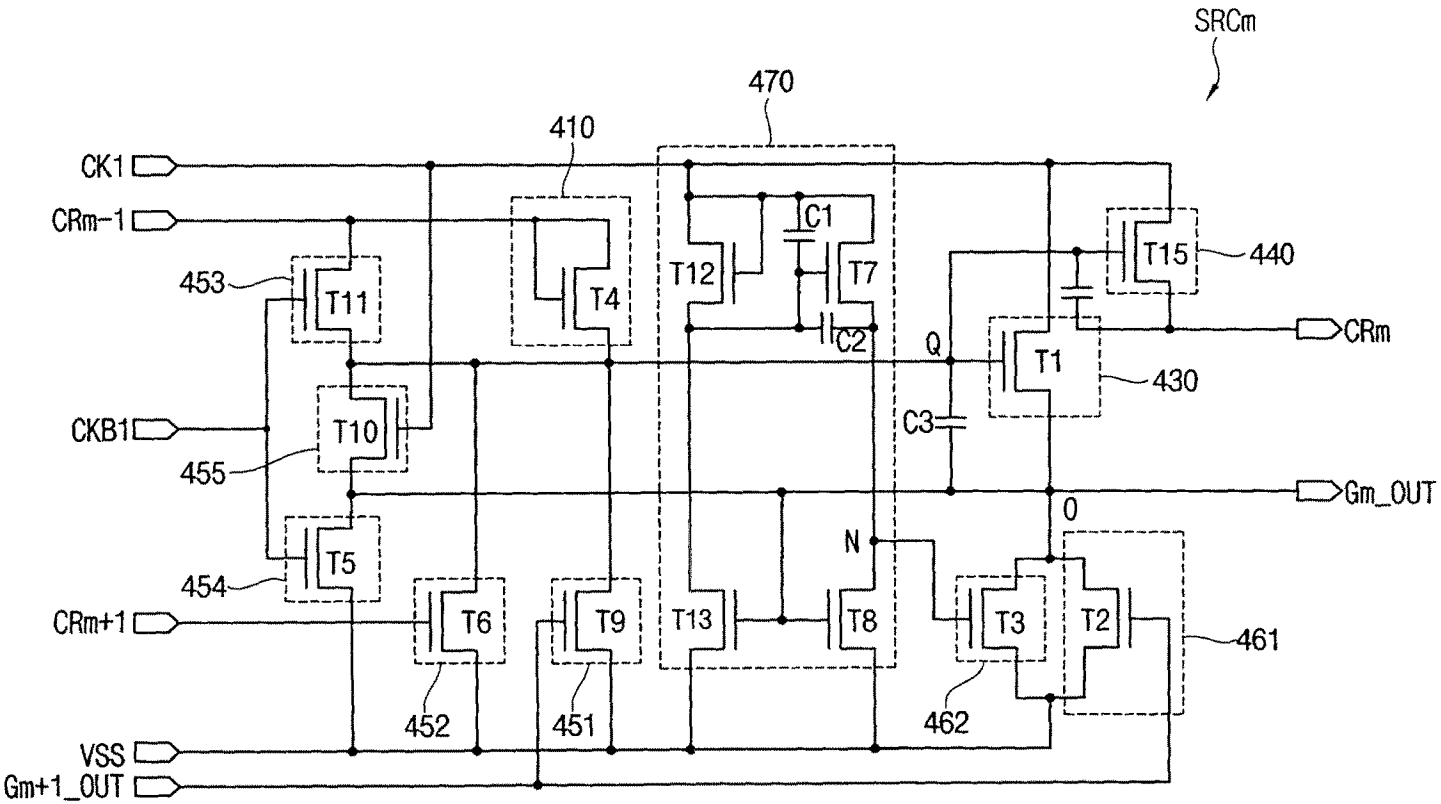
FIG. 4 is circuit diagram illustrating an m-th shift register of FIG. 2.

FIG. 4 is circuit diagram illustrating an m-th shift register of FIG. 2 according to an exemplary embodiment of the inventive concept.

Referring to FIGS. 2 and 4, an m-th shift register SRCm includes a buffer part 410, a pull-up part 430, a carry part 440, a first control pull-down part 451, a second control pull-down part 452, a first control holding part 453, a second control holding part 454, a third control holding part 455, a first output pull-down part 461, a second output pull-down part 462 and an inverter 470.

In an embodiment, the buffer part 410 is a transistor T4 whose gate terminal receives an (m−1)-th carry signal CRm−1 and is connected to a non-gate terminal of the transistor T4. In an embodiment, pull-up part 430 is a transistor T1. In an embodiment, the carry part 440 is a transistor T15 having a non-gate terminal that outputs an m-th carry signal CRm. In an embodiment, the first control pull-down part 451 is a transistor T9 whose gate terminal receives an (m+1)-th gate signal Gm+1_OUT and having a non-gate terminal receiving a low voltage VSS. In an embodiment, the second control pull-down part 452 is a transistor T6 having a gate terminal receiving an (m+1)-th carry signal CRm+1 and a non-gate terminal receiving the low voltage VSS. In an embodiment, the first control holding part 453 is a transistor T11. In an embodiment, the second control holding part 454 is a transistor T5. In an embodiment, the third control holding part 455 is a transistor T10 having a gate terminal receiving a first clock signal CK1. In an embodiment, the first output pull-down part 461 is a transistor T2 whose gate terminal receives the (m+1)-th gate signal Gm+1_OUT. In an embodiment, the second output pull-down part 462 is a transistor T3. In an embodiment, the inverter 470 includes transistors T7, T8, T12, and T13, and capacitors C1 and C2. In an embodiment, the m-th shift register SRCm includes a capacitor C3 connected between control node Q and output node O.

The buffer part 410 is configured to transfer the (m−1)-th carry signal CRm−1 to the pull-up part 430. When the buffer part 410 receives a high voltage of the (m−1)-th carry signal CRm−1, the high voltage of the (m−1)-th carry signal CRm−1 is applied to a control node Q.

The pull-up part 430 is configured to output an m-th gate signal Gm_OUT through an output node O. The pull-up part 430 is configured to boost up the high voltage of the control node Q to a boosting voltage in response to a high voltage of the first clock signal CK1.

When the boosting voltage is applied to the control node Q, the pull-up part 430 is configured to output the high voltage of the first clock signal CK as a high voltage of the m-th gate signal Gm_OUT.

The carry part 440 is configured to output the high voltage of the first clock signal CK1 as the m-th carry signal CRm in response to the high voltage of the control node Q.

The first control pull-down part 451 is configured to discharge the control node Q to a low voltage VSS in response to the (m+1)-th gate signal Gm+1_OUT. In an embodiment, the low voltage VSS is lower than a high period of the first clock signal CK1.

The second control pull-down part 452 is configured to discharge the control node Q to the low voltage VSS in response to the (m+1)-th carry signal CRm+1.

The first control holding part 453 is configured to maintain the control node Q to the low voltage VSS in response to a high voltage of a third clock signal CKB1 having a phase opposite to a phase of the first clock signal CK1. The second control holding part 454 is configured to maintain the output node O to the low voltage VSS in response to the high voltage of the second clock signal CKB1. The third control holding part 455 is configured to maintain the control node Q and the output node O to the low voltage VSS in response to the high voltage of the first clock signal CK1.

The inverter 470 is configured to supply a signal having a phase the same as the phase of the first clock signal CK1 to an inverting node N.

The first output pull-down part 461 is configured to pull-down the output node O to the low voltage VSS in response to the high voltage of an (m+1)-th gate signal Gm+1_OUT. The second output pull-down part 462 is configured to pull-down the output node O to the low voltage VSS in response to the signal applied to the inverting node N.

Figure 5:
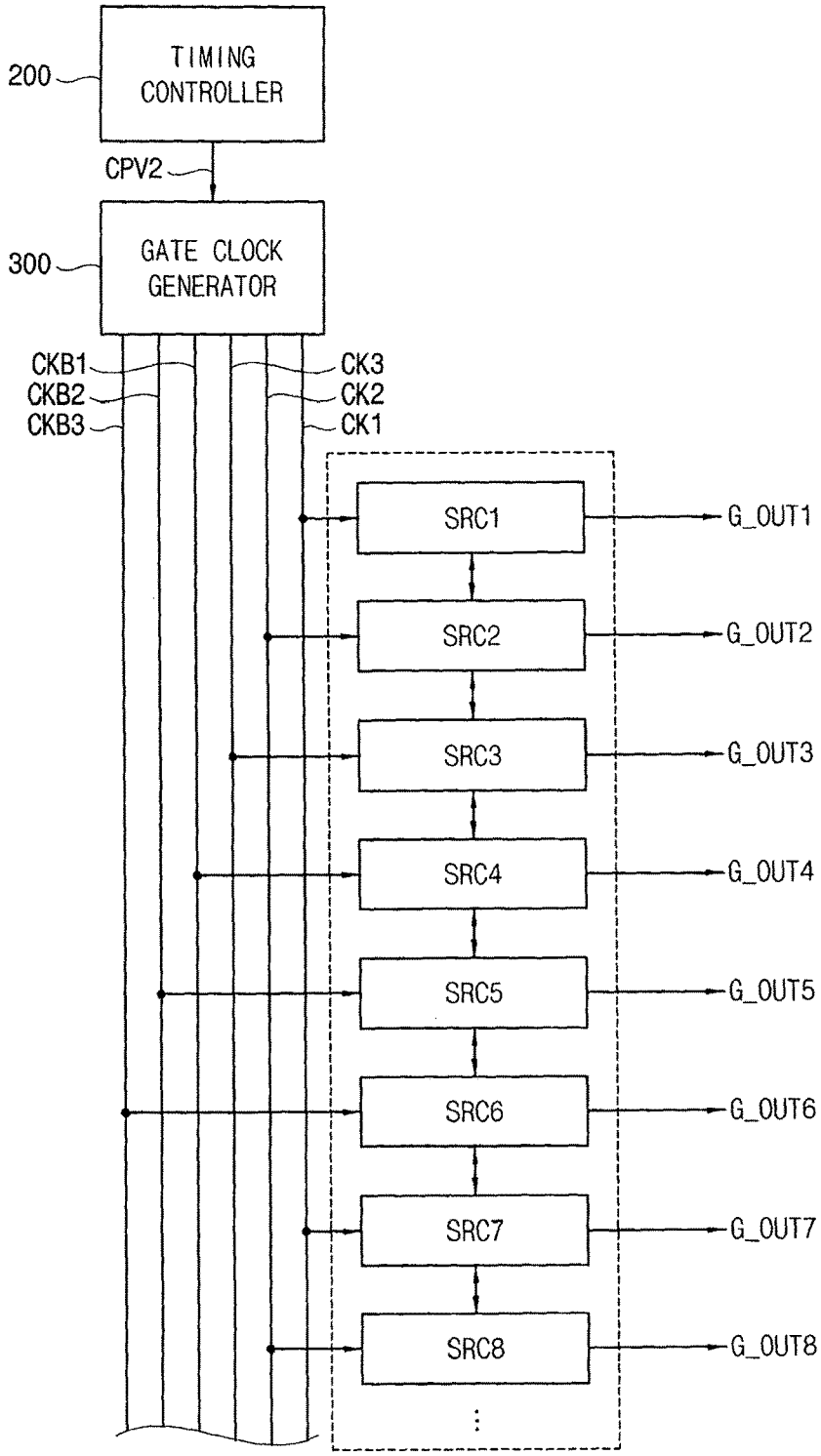
FIG. 5 is a block diagram illustrating a gate driver according to an exemplary embodiment of the inventive concept.
Figure 6:
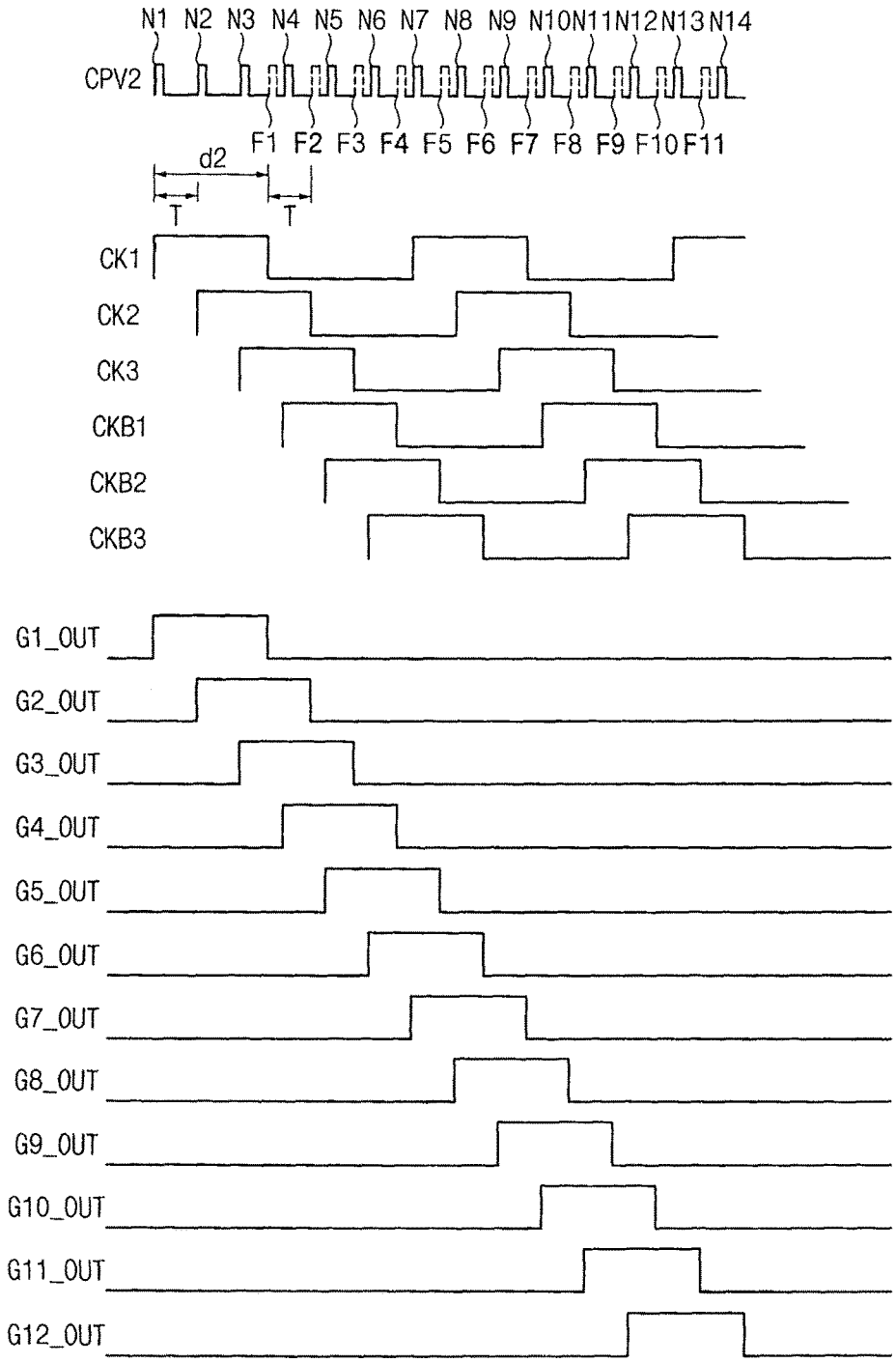
FIG. 6 is a waveform diagram illustrating a driving signal for the gate driver of FIG. 5 according to an exemplary embodiment of the inventive concept.

FIG. 5 is a block diagram illustrating a gate driver according to an exemplary embodiment of the inventive concept. FIG. 6 is a waveform diagram illustrating a driving signal for the gate driver of FIG. 5 according to an exemplary embodiment of the inventive concept.

Referring to FIGS. 5 and 6, the timing controller 200 is configured to output a single clock control signal CPV2. The gate clock generator 300 is configured to generate a plurality of clock signals based on the clock control signal CPV2.

According to an exemplary embodiment, the gate clock generator 300 is configured to generate a first clock signal CK1, a second clock signal CK2, a third clock signal CK3, a fourth clock signal CKB1, a fifth clock signal CKB2 and a sixth clock signal CKB3 based on the clock control signal CPV2.

For example, the clock control signal CPV2 may include a plurality of ON-control pulses N1, N2, N3, . . . , N14 and a plurality of OFF-control pulses F1, F2, F3, . . . , F11.

The plurality of ON-control pulses N1, N2, N3, . . . , N14 includes a pulse that repeats each time a first period T has elapsed and the plurality of OFF-control pulses F1, F2, F3, . . . , F11 includes a pulse that repeats each time the first period T has elapsed.

The first OFF-control pulse F1 is located between a third ON-control pulse N3 and a fourth ON-control pulse N4 and is delayed by a second delay difference d2 from a first ON-control pulse N1. In an embodiment, the second delay difference is greater than three periods (3T) and less than four periods (4T).

An ON-period of the first clock signal CK1 starts in response to the first ON-control pulse N1, and an OFF-period of the first clock signal CK1 starts in response to the first OFF-control pulse F1. Then, the ON-period of the first clock signal CK1 starts in response to a seventh ON-control pulse N7, and the OFF-period of the first clock signal CK1 starts in response to a seventh OFF-control pulse F7. As described above, ON-periods of the first clock signal CK1 sequentially start in response to (1+6K)-th ON-control pulses N1, N7 and N13, and OFF-periods of the first clock signal CK1 sequentially start in response to (1+6K)-th OFF-control pulses F1 and F7 ('K' is a natural number as 0, 1, 2, 3, . . . ).

The first clock signal CK1 is applied to (1+6K)-th shift registers SRC1 and SRC7 and controls ON-periods of (1+6K)-th gate signals G1_OUT and G7_OUT generated from the (1+6K)-th shift registers SRC1 and SRC7. The (1+6K)-th gate signals G1_OUT and G7_OUT are synchronized with the ON-periods of the first clock signal CK1.

An ON-period of the second clock signal CK2 starts in response to the second ON-control pulse N2 and an OFF-period of the second clock signal CK2 starts in response to a second OFF-control pulse F2. Then, the ON-period of the second clock signal CK2 starts in response to an eighth ON-control pulse N8 and the OFF-period of the second clock signal CK2 starts in response to an eighth OFF-control pulse F8. As described above, ON-periods of the second clock signal CK2 sequentially start in response to (2+6K)-th ON-control pulses N2 and N8, and OFF-periods of the second clock signal CK2 sequentially start in response to (2+6K)-th OFF-control pulses F2 and F8 ('K' is a natural number as 0, 1, 2, 3, . . . ).

The second clock signal CK2 is applied to (2+6K)-th shift registers SRC2 and SRC8 and controls ON-periods of (2+6K)-th gate signals G2_OUT and G8_OUT generated from the (2+6K)-th shift registers SRC2 and SRC8. The (2+6K)-th gate signals G2_OUT and G8_OUT are synchronized with the ON-periods of the second clock signal CK2.

An ON-period of the third clock signal CK3 starts in response to a third ON-control pulse N3 and an OFF-period of the third clock signal CK3 starts in response to a third OFF-control pulse F3. Then, the ON-period of the third clock signal CK3 starts in response to a ninth ON-control pulse N9 and the OFF-period of the third clock signal CK3 starts in response to a ninth OFF-control pulse F9. As described above, ON-periods of the third clock signal CK3 sequentially start in response to (3+6K)-th ON-control pulses N3 and N9, and OFF-periods of the third clock signal CK3 sequentially start in response to (3+6K)-th OFF-control pulses F3 and F9 ('K' is a natural number as 0, 1, 2, 3, . . . ).

The third clock signal CK3 is applied to (3+6K)-th shift registers SRC3 and SRC9 and controls ON-periods of (3+6K)-th gate signals G3_OUT and G9_OUT generated from the (3+6K)-th shift registers SRC3 and SRC9. The (3+6K)-th gate signals G3_OUT and G9_OUT are synchronized with the ON-periods of the third clock signal CK3.

An ON-period of the fourth clock signal CKB1 starts in response to a fourth ON-control pulse N4 and an OFF-period of the fourth clock signal CKB1 starts in response to a fourth OFF-control pulse F4. Then, the ON-period of the fourth clock signal CKB1 starts in response to a tenth ON-control pulse N10 and the OFF-period of the fourth clock signal CKB1 starts in response to a tenth OFF-control pulse F10. As described above, ON-periods of the fourth clock signal CKB1 sequentially start in response to (4+6K)-th ON-control pulses N4 and N10, and OFF-periods of the fourth clock signal CKB1 sequentially start in response to (4+6K)-th OFF-control pulses F4 and F10 ('K' is a natural number as 0, 1, 2, 3, . . . ).

The ON-period of the fourth clock signal CKB1 may correspond to the OFF-period of the first clock signal CK1, and the OFF-period of the fourth clock signal CKB1 may correspond to the ON-period of the first clock signal CK1. For example, in an embodiment, the ON-period of the fourth clock signal CKB1 occurs during the OFF-period of the first clock signal CK1, and part of the OFF-period of the fourth clock signal CKB1 occurs during the ON-period of the first clock signal CK1.

The fourth clock signal CKB1 is applied to (4+6K)-th shift registers SRC4 and SRC10 and controls ON-periods of (4+6K)-th gate signals G4_OUT and G10_OUT generated from the (4+6K)-th shift registers SRC4 and SRC10. The (4+6K)-th gate signals G4_OUT and G10_OUT are synchronized with the ON-periods of the fourth clock signal CKB1.

An ON-period of the fifth clock signal CKB2 starts in response to a fifth ON-control pulse N5 and an OFF-period of the fifth clock signal CKB2 starts in response to a fifth OFF-control pulse F5. Then, the ON-period of the fifth clock signal CKB2 starts in response to an eleventh ON-control pulse N11 and the OFF-period of the fifth clock signal CKB2 starts in response to an eleventh OFF-control pulse F11. As described above, ON-periods of the fifth clock signal CKB2 sequentially start in response to (5+6K)-th ON-control pulses N5 and N11, and OFF-periods of the fourth clock signal CKB2 sequentially start in response to (5+6K)-th OFF-control pulses F5 and F11 ('K' is a natural number as 0, 1, 2, 3, . . . ).

The ON-period of the fifth clock signal CKB2 may correspond to the OFF-period of the second clock signal CK2 and the OFF-period of the fifth clock signal CKB2 may correspond to the ON-period of the second clock signal CK2. For example, in an embodiment, the ON-period of the fifth clock signal CKB2 occurs during the OFF-period of the second clock signal CK2, and part of the OFF-period of the fifth clock signal CKB2 occurs during the ON-period of the second clock signal CK2.

The fifth clock signal CKB2 is applied to (5+6K)-th shift register SRC5 and SRC11 and controls ON-periods of (5+6K)-th gate signals G5_OUT and G11_OUT generated from the (5+6K)-th shift registers SRC5 and SRC11. The (5+6K)-th gate signals G5_OUT and G11_OUT are synchronized with the ON-periods of the fifth clock signal CKB2.

An ON-period of the sixth clock signal CKB3 starts in response to a sixth ON-control pulse N6 and an OFF-period of the sixth clock signal CKB3 starts in response to a sixth OFF-control pulse F6. Then, the ON-period of the sixth clock signal CKB3 starts in response to a twelfth ON-control pulse N12 and the OFF-period of the sixth clock signal CKB3 starts in response to a twelfth OFF-control pulse F12.

As described above, ON-periods of the sixth clock signal CKB3 sequentially start in response to (6+6K)-th ON-control pulses N6 and N12, and OFF-periods of the sixth clock signal CKB3 sequentially start in response to (6+6K)-th OFF-control pulses F6 and F12 ('K' is a natural number as 0, 1, 2, 3, . . . ).

The ON-period of the sixth clock signal CKB3 may correspond to the OFF-period of the third clock signal CK3 and the OFF-period of the sixth clock signal CKB3 may correspond to the ON-period of the third clock signal CK3. For example, in an embodiment, the ON-period of the sixth clock signal CKB3 occurs during the OFF-period of the third clock signal CK3, and part of the OFF-period of the sixth clock signal CKB3 occurs during the ON-period of the third clock signal CK3.

The sixth clock signal CKB3 is applied to (6+6K)-th shift registers SRC6 and SRC12 and controls ON-periods of (6+6K)-th gate signals G6_OUT and G12_OUT generated from the (6+6K)-th shift registers SRC6 and SRC12. The (6+6K)-th gate signals G6_OUT and G12_OUT are synchronized with the ON-periods of the sixth clock signal CKB3.

According to an exemplary embodiment, six clock signals CK1, CK2, CK3, CKB1, CKB2 and CKB3 are generated based on the single clock control signal CPV2. Therefore, a number of pins transmitting signals from the timing controller 200 to the gate clock generator 300 may be decreased.

Figure 7:
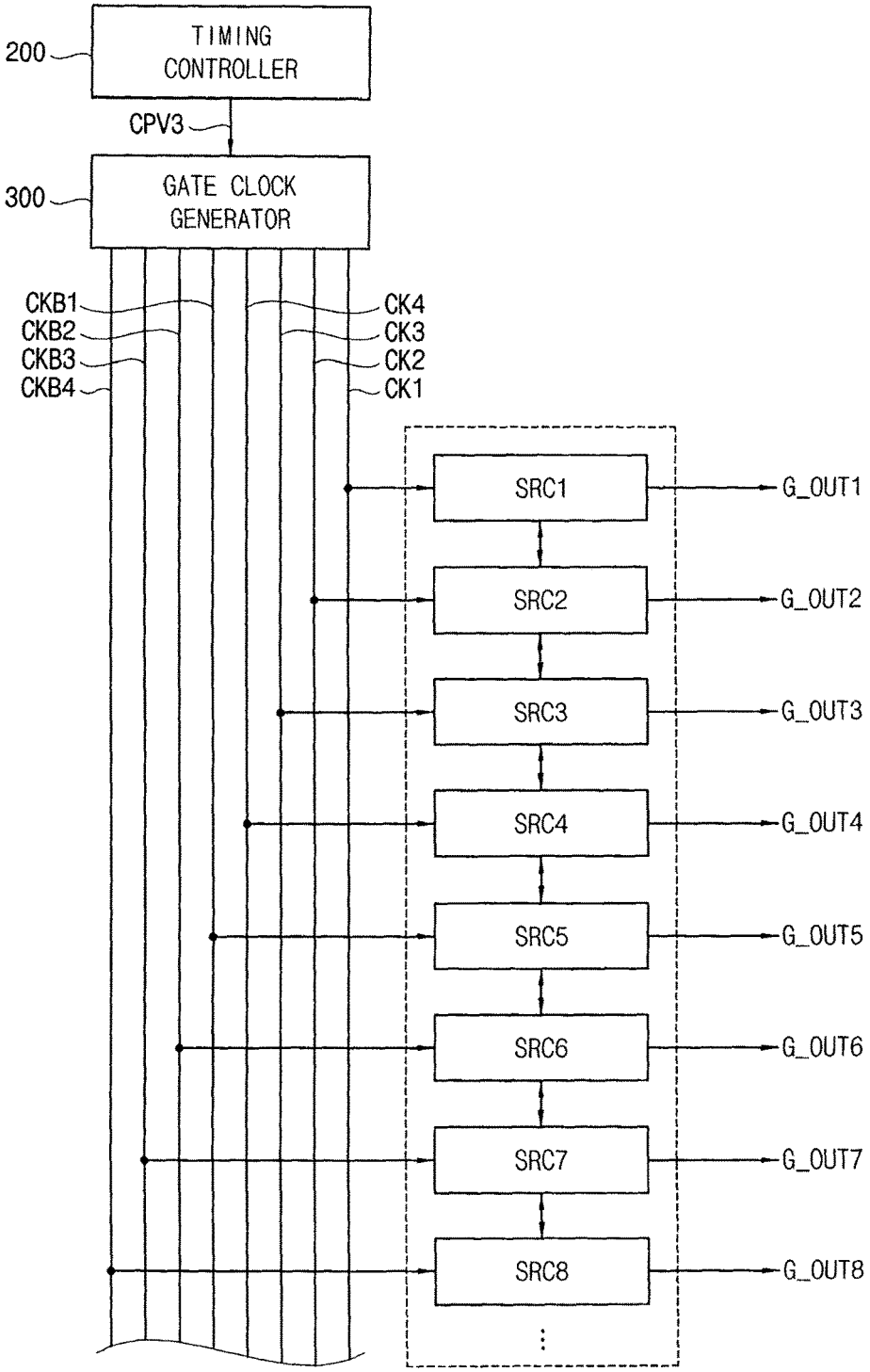
FIG. 7 is a block diagram illustrating a gate driver according to an exemplary embodiment of the inventive concept.
Figure 8:
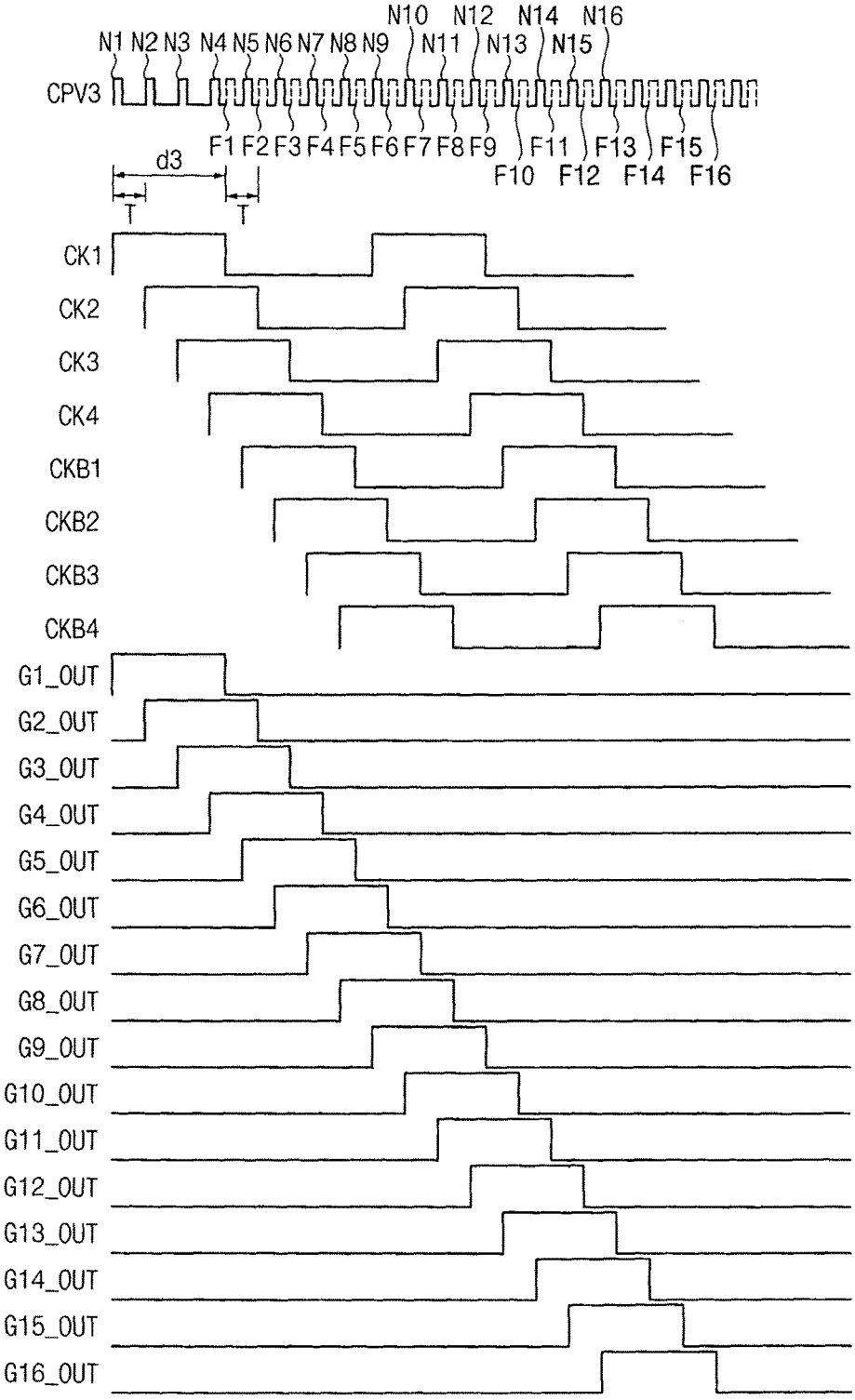
FIG. 8 is a waveform diagram illustrating a driving signal for the gate driver of FIG. 7 according to an exemplary embodiment of the inventive concept.

FIG. 7 is a block diagram illustrating a gate driver according to an exemplary embodiment of the inventive concept. FIG. 8 is a waveform diagram illustrating a driving signal for the gate driver of FIG. 7 according to an exemplary embodiment of the inventive concept.

Referring to FIGS. 7 and 8, the timing controller 200 is configured to output a single clock control signal CPV3. The gate clock generator 300 is configured to generate a plurality of clock signals based on the clock control signal CPV3.

According to an exemplary embodiment, the gate clock generator 300 is configured to generate a first clock signal CK1, a second clock signal CK2, a third clock signal CK3, a fourth clock signal CK4, a fifth clock signal CKB1, a sixth clock signal CKB2, a seventh clock signal CKB3 and an eighth clock signal CKB4 based on the clock control signal CPV3.

For example, the clock control signal CPV3 may include a plurality of ON-control pulses N1, N2, N3, . . . , N16 and a plurality of OFF-control pulses F1, F2, F3, . . . , F16.

The plurality of ON-control pulses N1, N2, N3, . . . , N16 include a pulse that repeats each time a first period T has elapsed and the plurality of OFF-control pulses F1, F2, F3, . . . , F16 include a pulse that repeats each time the first period T has elapsed.

The first OFF-control pulse F1 is located between a fourth ON-control pulse N4 and a fifth ON-control pulse N5 and is delayed by a third delay difference d3 from a first ON-control pulse N1. In an embodiment, the third delay difference is greater than four periods (4T) and less than five periods (5T).

An ON-period of the first clock signal CK1 starts in response to the first ON-control pulse N1, and an OFF-period of the first clock signal CK1 starts in response to the first OFF-control pulse F1. Then, the ON-period of the first clock signal CK1 starts in response to a ninth ON-control pulse N9, and the OFF-period of the first clock signal CK1 starts in response to a ninth OFF-control pulse F9. As described above, ON-periods of the first clock signal CK1 sequentially start in response to (1+8K)-th ON-control pulses N1, N9 and N17, and OFF-periods of the first clock signal CK1 sequentially start in response to (1+8K)-th OFF-control pulses F1 and F9 ('K' is a natural number as 0, 1, 2, 3, . . . ).

The first clock signal CK1 is applied to (1+8K)-th shift registers SRC1 and SRC9 and controls ON-periods of (1+8K)-th gate signals G1_OUT and G9_OUT generated from the (1+8K)-th shift registers SRC1 and SRC9. The (1+8K)-th gate signals G1_OUT and G9_OUT are synchronized with the ON-periods of the first clock signal CK1.

An ON-period of the second clock signal CK2 starts in response to the second ON-control pulse N2 and an OFF-period of the second clock signal CK2 starts in response to a second OFF-control pulse F2. Then, the ON-period of the second clock signal CK2 starts in response to a tenth ON-control pulse N10 and the OFF-period of the second clock signal CK2 starts in response to a tenth OFF-control pulse F10. As described above, ON-periods of the second clock signal CK2 sequentially start in response to (2+8K)-th ON-control pulses N2 and N10, and OFF-periods of the second clock signal CK2 sequentially start in response to (2+8K)-th OFF-control pulses F2 and F10 ('K' is a natural number as 0, 1, 2, 3, . . . ).

The second clock signal CK2 is applied to (2+8K)-th shift registers SRC2 and SRC10 and controls ON-periods of (2+8K)-th gate signals G2_OUT and G10_OUT generated from the (2+8K)-th shift registers SRC2 and SRC10. The (2+8K)-th gate signals G2_OUT and G10_OUT are synchronized with the ON-periods of the second clock signal CK2.

An ON-period of the third clock signal CK3 starts in response to a third ON-control pulse N3 and an OFF-period of the third clock signal CK3 starts in response to a third OFF-control pulse F3. Then, the ON-period of the third clock signal CK3 starts in response to an eleventh ON-control pulse N11 and the OFF-period of the third clock signal CK3 starts in response to an eleventh OFF-control pulse F11. As described above, ON-periods of the third clock signal CK3 sequentially start in response to (3+8K)-th ON-control pulses N3 and N11, and OFF-periods of the third clock signal CK3 sequentially start in response to (3+8K)-th OFF-control pulses F3 and F11 ('K' is a natural number as 0, 1, 2, 3, . . . ).

The third clock signal CK3 is applied to (3+8K)-th shift registers SRC3 and SRC11 and controls ON-periods of (3+8K)-th gate signals G3_OUT and G11_OUT generated from the (3+8K)-th shift registers SRC3 and SRC11. The (3+8K)-th gate signals G3_OUT and G11_OUT are synchronized with the ON-periods of the third clock signal CK3.

An ON-period of the fourth clock signal CK4 starts in response to a fourth ON-control pulse N4 and an OFF-period of the fourth clock signal CK4 starts in response to a fourth OFF-control pulse F4. Then, the ON-period of the fourth clock signal CK4 starts in response to a twelfth ON-control pulse N12 and the OFF-period of the fourth clock signal CK4 starts in response to a twelfth OFF-control pulse F12. As described above, ON-periods of the fourth clock signal CK4 sequentially start in response to (4+8K)-th ON-control pulses N4 and N12, and OFF-periods of the fourth clock signal CK4 sequentially start in response to (4+8K)-th OFF-control pulses F4 and F12 ('K' is a natural number as 0, 1, 2, 3, . . . ).

The fourth clock signal CK4 is applied to (4+8K)-th shift registers SRC4 and SRC12 and controls ON-periods of (4+8K)-th gate signals G4_OUT and G12_OUT generated from the (4+8K)-th shift registers SRC4 and SRC12. The (4+8K)-th gate signals G4_OUT and G12_OUT are synchronized with the ON-periods of the fourth clock signal CK4.

An ON-period of the fifth clock signal CKB1 starts in response to a fifth ON-control pulse N5 and an OFF-period of the fifth clock signal CKB1 starts in response to a fifth OFF-control pulse F5. Then, the ON-period of the fifth clock signal CKB1 starts in response to a thirteenth ON-control pulse N13 and the OFF-period of the fifth clock signal CKB1 starts in response to a thirteenth OFF-control pulse F13. As described above, ON-periods of the fifth clock signal CKB1 sequentially start in response to (5+8K)-th ON-control pulses N5 and N13, and OFF-periods of the fifth clock signal CKB1 sequentially start in response to (5+8K)-th OFF-control pulses F5 and F13 ('K' is a natural number as 0, 1, 2, 3, . . . ).

The fifth clock signal CKB1 is applied to (5+8K)-th shift registers SRC5 and SRC13 and controls ON-periods of (5+8K)-th gate signals G5_OUT and G13_OUT generated from the (5+8K)-th shift registers SRC5 and SRC13. The (5+8K)-th gate signals G5_OUT and G13_OUT are synchronized with the ON-periods of the fifth clock signal CKB1.

The ON-period of the fifth clock signal CKB1 may correspond to the OFF-period of the first clock signal CK1, and the OFF-period of the fifth clock signal CKB1 may correspond to the ON-period of the first clock signal CK1.

An ON-period of the sixth clock signal CKB2 starts in response to a sixth ON-control pulse N6 and an OFF-period of the sixth clock signal CKB2 starts in response to a sixth OFF-control pulse F6. Then, the ON-period of the sixth clock signal CKB2 starts in response to a fourteenth ON-control pulse N14 and the OFF-period of the sixth clock signal CKB2 starts in response to a fourteenth OFF-control pulse F14. As described above, ON-periods of the sixth clock signal CKB2 sequentially start in response to (6+8K)-th ON-control pulses N6 and N14, and OFF-periods of the sixth clock signal CKB2 sequentially start in response to (6+8K)-th OFF-control pulses F6 and F14 ('K' is a natural number as 0, 1, 2, 3, . . . ).

The sixth clock signal CKB2 is applied to (6+8K)-th shift registers SRC6 and SRC14 and controls ON-periods of (6+8K)-th gate signals G6_OUT and G14_OUT generated from the (6+8K)-th shift registers SRC6 and SRC14. The (6+8K)-th gate signals G6_OUT and G14_OUT are synchronized with the ON-periods of the sixth clock signal CKB2.

The ON-period of the sixth clock signal CKB2 may correspond to the OFF-period of the second clock signal CK2 and the OFF-period of the sixth clock signal CKB2 may correspond to the ON-period of the second clock signal CK2.

An ON-period of the seventh clock signal CKB3 starts in response to a seventh ON-control pulse N7 and an OFF-period of the seventh clock signal CKB3 starts in response to a seventh OFF-control pulse F7. Then, the ON-period of the seventh clock signal CKB3 starts in response to a fifteenth ON-control pulse N15 and the OFF-period of the seventh clock signal CKB3 starts in response to a fifteenth OFF-control pulse F15. As described above, ON-periods of the seventh clock signal CKB3 sequentially start in response to (7+8K)-th ON-control pulses N7 and N15, and OFF-periods of the seventh clock signal CKB3 sequentially start in response to (7+8K)-th OFF-control pulses F7 and F15 ('K' is a natural number as 0, 1, 2, 3, . . . ).

The seventh clock signal CKB3 is applied to (7+8K)-th shift registers SRC7 and SRC15 and controls ON-periods of (7+8K)-th gate signals G7_OUT and G15_OUT generated from the (7+8K)-th shift registers SRC7 and SRC15. The (7+8K)-th gate signals G7_OUT and G15_OUT are synchronized with the ON-periods of the seventh clock signal CKB3.

The ON-period of the seventh clock signal CKB3 may correspond to the OFF-period of the third clock signal CK3 and the OFF-period of the seventh clock signal CKB3 may correspond to the ON-period of the third clock signal CK3.

An ON-period of the eighth clock signal CKB4 starts in response to an eighth ON-control pulse N8 and an OFF-period of the eighth clock signal CKB4 starts in response to an eighth OFF-control pulse F8. Then, the ON-period of the eighth clock signal CKB4 starts in response to a sixteenth ON-control pulse N16 and the OFF-period of the eighth clock signal CKB4 starts in response to a sixteenth OFF-control pulse F16. As described above, ON-periods of the eighth clock signal CKB4 sequentially start in response to (8+8K)-th ON-control pulses N8 and N16, and OFF-periods of eighth clock signal CKB4 sequentially start in response to (8+8K)-th OFF-control pulses F8 and F16 ('K' is a natural number as 0, 1, 2, 3, . . . ).

The eighth clock signal CKB4 is applied to (8+8K)-th shift registers SRC8 and SRC16 and controls ON-periods of (8+8K)-th gate signals G8_OUT and G16_OUT generated from the (8+8K)-th shift registers SRC8 and SRC16. The (8+8K)-th gate signals G8_OUT and G16_OUT are synchronized with the ON-periods of the eighth clock signal CKB4.

The ON-period of the eighth clock signal CKB4 may correspond to the OFF-period of the fourth clock signal CK4 and the OFF-period of the eighth clock signal CKB4 may correspond to the ON-period of the fourth clock signal CK4.

According to the exemplary embodiment, eight clock signals CK1, CK2, CK3, CK4, CKB1, CKB2, CKB3 and CKB4 are generated based on the single clock control signal CPV3. Therefore, a number of pins transmitting signals from the timing controller 200 to the gate clock generator 300 may be decreased.

Figure 9:
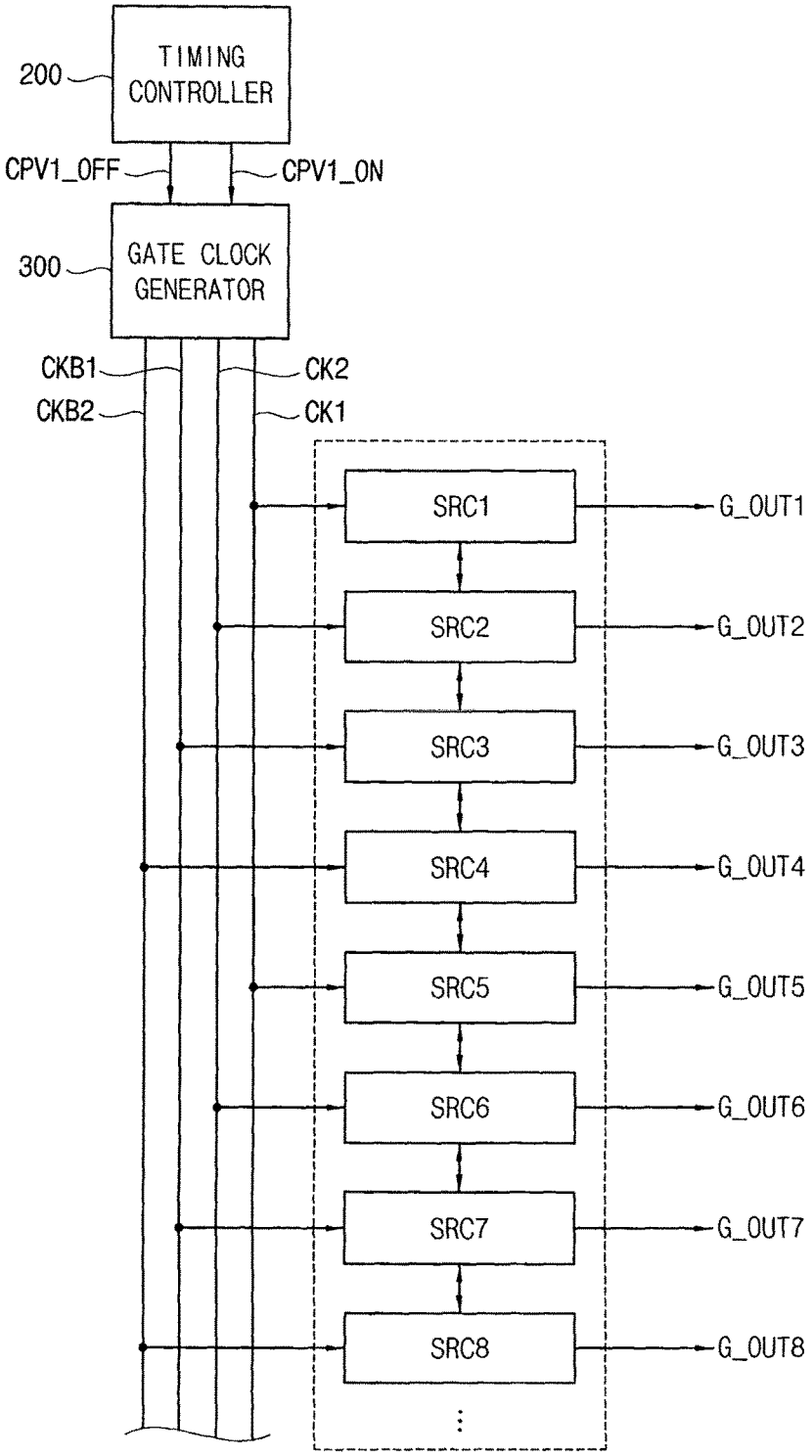
FIG. 9 is a block diagram illustrating a gate driver according to an exemplary embodiment of the inventive concept.
Figure 10:
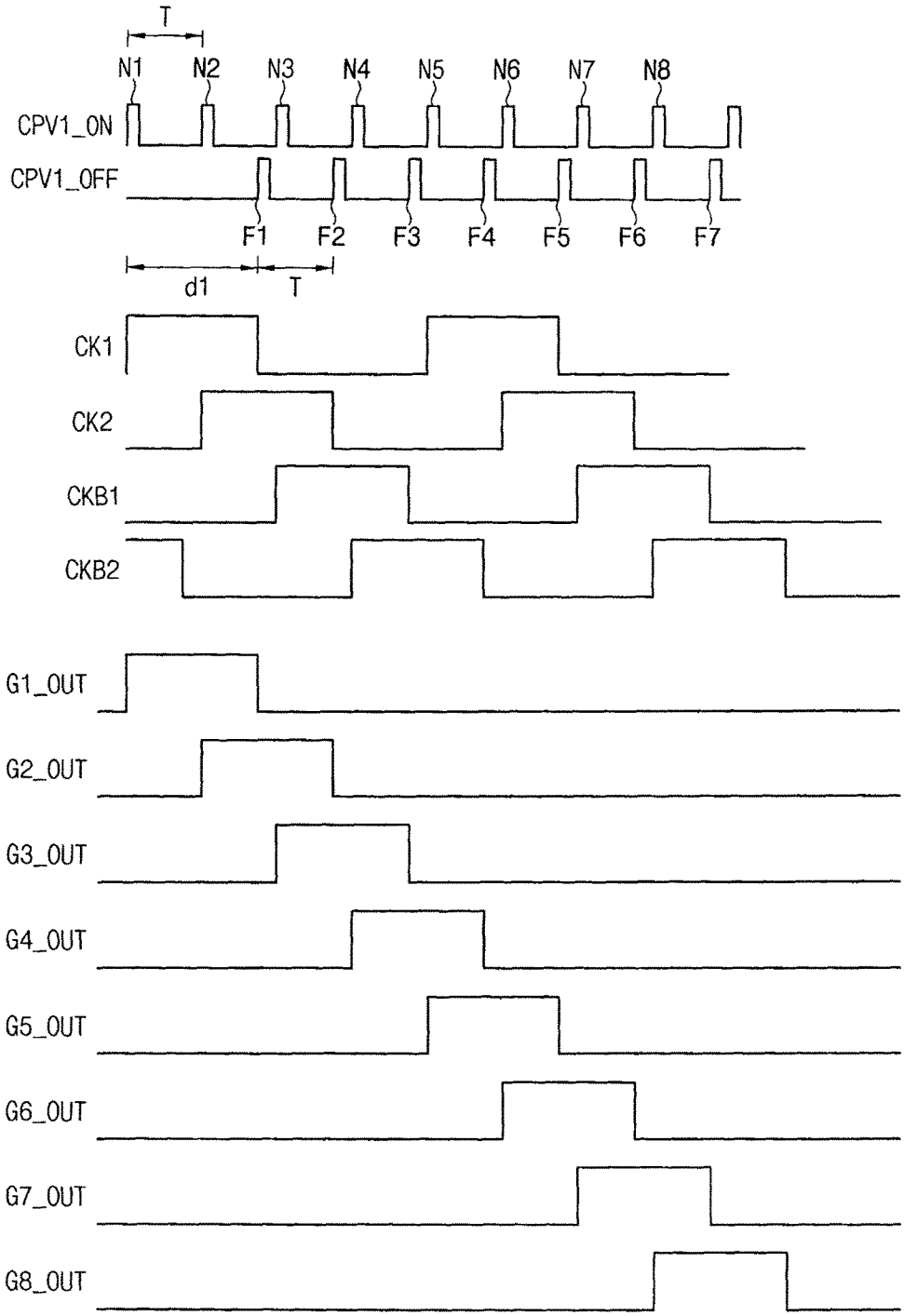
FIG. 10 is a waveform diagram illustrating a driving signal for the gate driver of FIG. 9 according to an exemplary embodiment of the inventive concept.

FIG. 9 is a block diagram illustrating a gate driver according to an exemplary embodiment of the inventive concept. FIG. 10 is a waveform diagram illustrating a driving signal for the gate driver of FIG. 9 according to an exemplary embodiment of the inventive concept.

Referring to FIGS. 9 and 10, the timing controller 200 is configured to output a first clock control signal CPV1_ON and a second clock control signal CVP1_OFF.

The first clock control signal CPV1_ON may include a plurality of ON-control pulses N1, N2, N3, . . . , N8 and the second clock control signal CVP1_OFF may include a plurality of OFF-control pulses F1, F2, F3, . . . , F7. The plurality of ON-control pulses N1, N2, N3, . . . , N8 includes a pulse that repeats each time first period T elapses and the plurality of OFF-control pulses F1, F2, F3, . . . , F7 include a pulse that repeats each time the first period T elapses. The first OFF-control pulse F1 is located between a second ON-control pulse N2 and a third ON-control pulse N3 and is delayed by a first delay difference d1 from a first ON-control pulse N1.

According to the exemplary embodiment, the gate clock generator 300 is configured to generate a first clock signal CK1, a second clock signal CK2, a third clock signal CKB1 and a fourth clock signal CKB2 based on the first and second clock control signals CPV1_ON and CVP1_OFF.

ON-periods of the first clock signal CK1 sequentially start in response to (1+4K)-th ON-control pulses N1 and N5 of the first clock control signal CPV1_ON and OFF-periods of the first clock signal CK1 sequentially start in response to (1+4K)-th OFF-control pulses F1 and F5 of the second clock control signal CPV1_OFF ('K' is a natural number as 0, 1, 2, 3, . . . ).

The first clock signal CK1 is applied to (1+4K)-th shift registers SRC1 and SRC5 and controls ON-periods of (1+4K)-th gate signals G1_OUT and G5_OUT generated from the (1+4K)-th shift registers SRC1 and SRC5. The (1+4K)-th gate signals G1_OUT and G5_OUT are synchronized with the ON-periods of the first clock signal CK1.

ON-periods of the second clock signal CK2 sequentially start in response to (2+4K)-th ON-control pulses N2 and N6 of the first clock control signal CPV1_ON and OFF-periods of the second clock signal CK2 sequentially start in response to (2+4K)-th OFF-control pulses F2 and F6 of the second clock control signal CPV1_OFF ('K' is a natural number as 0, 1, 2, 3, . . . ).

The second clock signal CK2 is applied to (2+4K)-th shift registers SRC2 and SRC6 and controls ON-periods of (2+4K)-th gate signals G2_OUT and G6_OUT generated from the (2+4K)-th shift registers SRC2 and SRC6. The (2+4K)-th gate signals G2_OUT and G6_OUT are synchronized with the ON-periods of the second clock signal CK2.

ON-periods of the third clock signal CKB1 sequentially start in response to (3+4K)-th ON-control pulses N3 and N7 of the first clock control signal CPV1_ON and OFF-periods of the third clock signal CKB1 sequentially start in response to (3+4K)-th OFF-control pulses F3 and F7 of the second clock control signal CPV1_OFF ('K' is a natural number as 0, 1, 2, 3, . . . ).

The third clock signal CKB1 is applied to (3+4K)-th shift registers SRC3 and SRC7 and controls ON-periods of (3+4K)-th gate signals G3_OUT and G7_OUT generated from the (3+4K)-th shift registers SRC3 and SRC7. The (3+4K)-th gate signals G3_OUT and G7_OUT are synchronized with the ON-periods of the third clock signal CKB1.

ON-periods of the fourth clock signal CKB2 sequentially start in response to (4+4K)-th ON-control pulses N4 and N8 of the first clock control signal CPV1_ON and OFF-periods of the fourth clock signal CKB2 sequentially start in response to (4+4K)-th OFF-control pulses F4 and F8 of the second clock control signal CPV1_OFF ('K' is a natural number as 0, 1, 2, 3, . . . ).

The fourth clock signal CKB2 is applied to (4+4K)-th shift registers SRC4 and SRC8 and controls ON-periods of (4+4K)-th gate signals G4_OUT and G8_OUT generated from the (4+4K)-th shift registers SRC4 and SRC8. The (4+4K)-th gate signals G4_OUT and G8_OUT are synchronized with the ON-periods of the fourth clock signal CKB2.

According to the exemplary embodiment, four clock signals CK1, CK2, CKB1 and CKB2 are generated based on two clock control signals CPV1_ON and CPV1_OFF. Therefore, a number of pins transmitting signals from the timing controller 200 to the gate clock generator 300 may be decreased. For example, if the four clock signals CK1, CK2, CKB1 and CKB2 are not generated from the two clock control signals CPV1_ON and CPV1_OFF, then they could be transmitted from four respective output pins of the timing controller 200 to four respective input pins of the gate clock generator 300. However, since the gate clock generator 300 can generate the four clock signals CK1, CK2, CKB1 and CKB2 from the two clock control signals CPV1_ON and CPV1_OFF, the timing controller 200 needs only two output pins to transmit the two clock control signals CPV1_ON and CPV1_OFF and the gate clock generator 300 needs only a two input pins to receive the two clock control signals CPV1_ON and CPV1_OFF.

Figure 11:
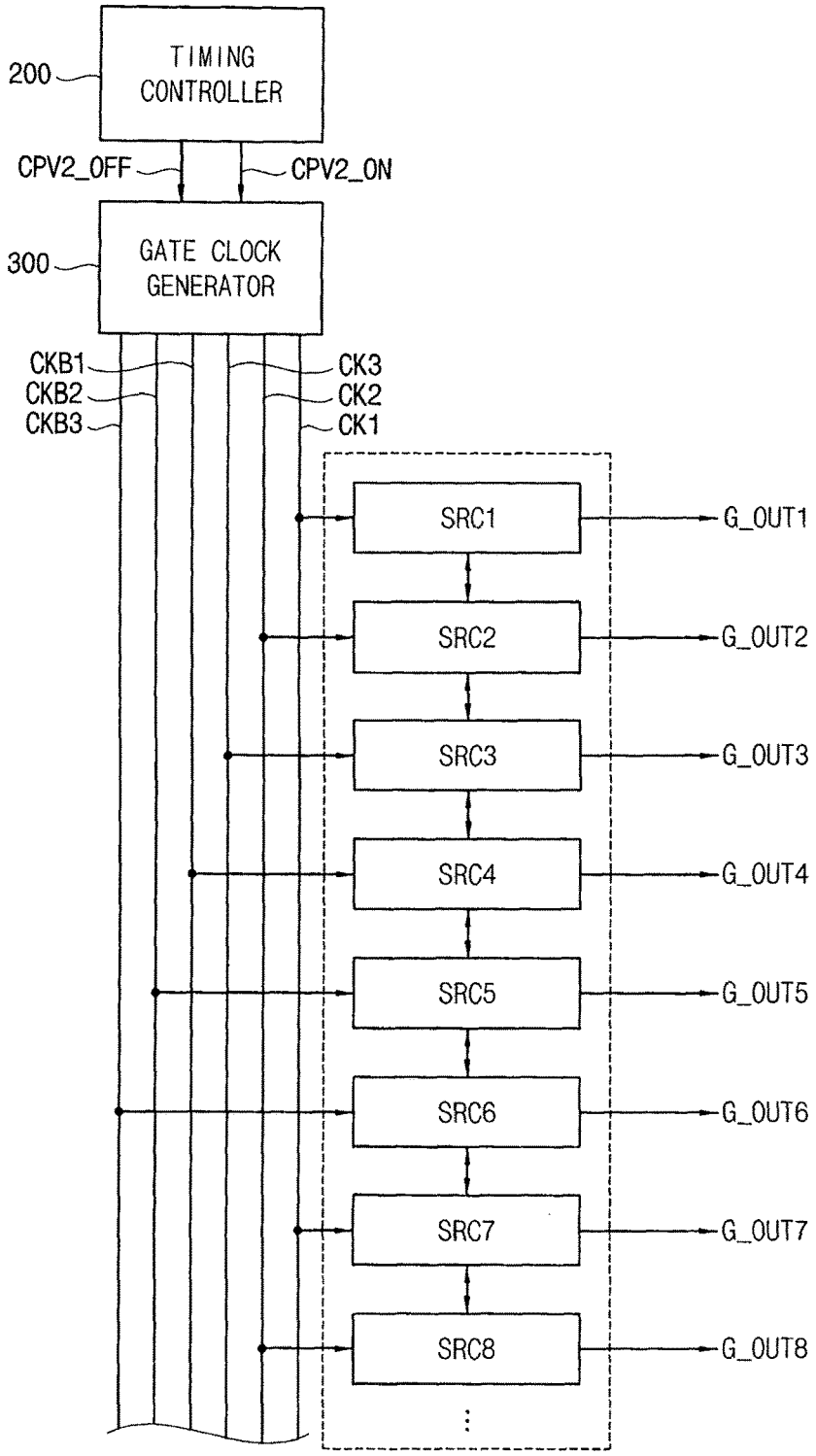
FIG. 11 is a block diagram illustrating a gate driver according to an exemplary embodiment of the inventive concept.
Figure 12:
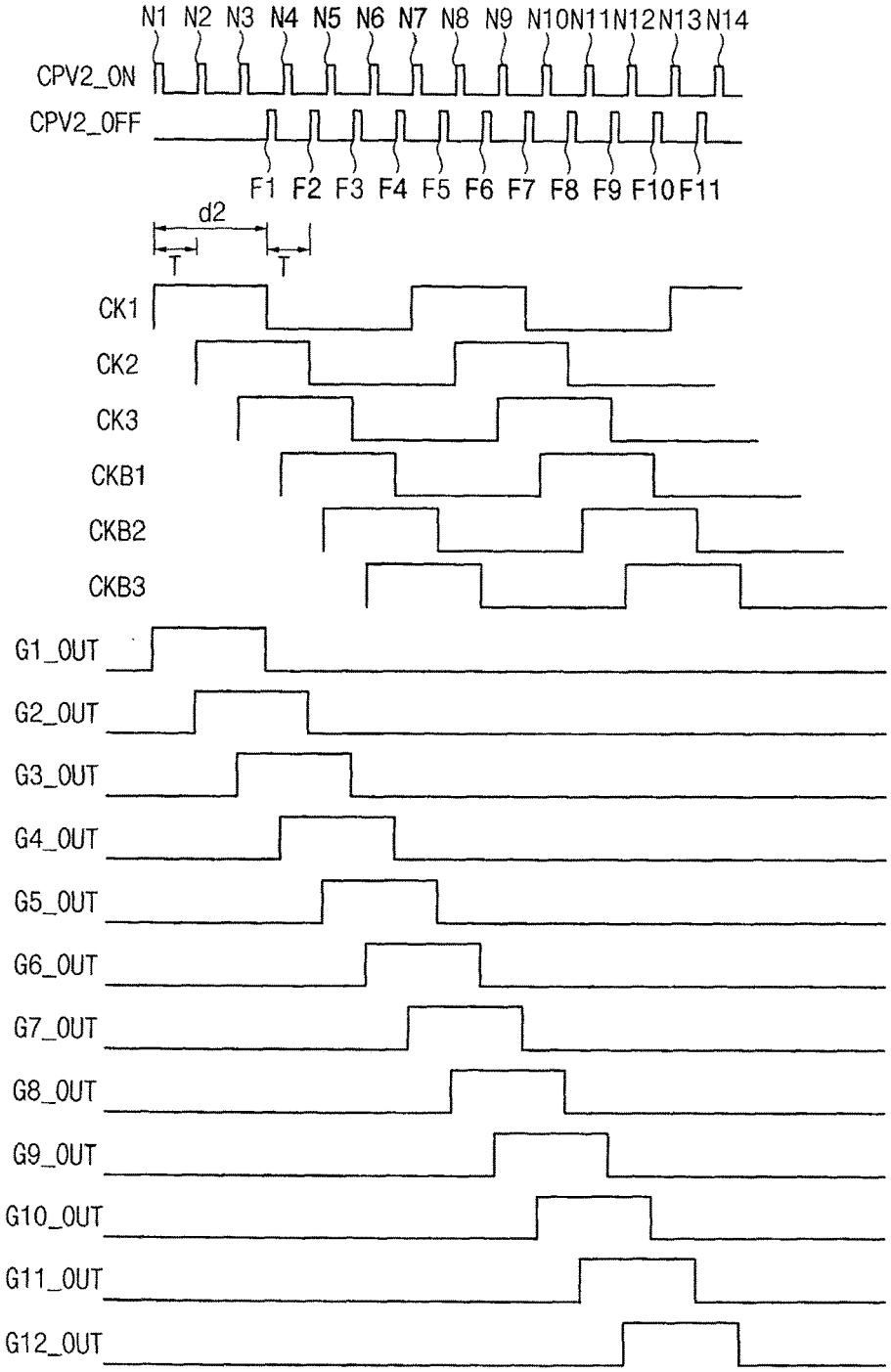
FIG. 12 is a waveform diagram illustrating a driving signal for the gate driver of FIG. 11.

FIG. 11 is a block diagram illustrating a gate driver according to an exemplary embodiment of the inventive concept. FIG. 12 is a waveform diagram illustrating a driving signal for the gate driver of FIG. 11 according to an exemplary embodiment of the inventive concept.

Referring to FIGS. 11 and 12, the timing controller 200 is configured to output a first clock control signal CPV2_ON and a second clock control signal CVP2_OFF.

The first clock control signal CPV2_ON may include a plurality of ON-control pulses N1, N2, N3, . . . , N14 and the second clock control signal CVP2_OFF may include a plurality of OFF-control pulses F1, F2, F3, . . . , F11. The plurality of ON-control pulses N1, N2, N3, . . . , N14 include a pulse that repeats each time a first period T elapses and the plurality of OFF-control pulses F1, F2, F3, . . . , F11 include a pulse that repeats each time the first period T elapses. The first OFF-control pulse F1 is located between a third ON-control pulse N3 and a fourth ON-control pulse N4 and is delayed by a second delay difference d2 from a first ON-control pulse N1.

According to the exemplary embodiment, the gate clock generator 300 is configured to generate a first clock signal CK1, a second clock signal CK2, a third clock signal CK3, a fourth clock signal CKB1, a fifth clock signal CKB2 and a sixth clock signal CKB3 based on the first and second clock control signals CPV2_ON and CVP2_OFF.

ON-periods of the first clock signal CK1 sequentially start in response to (1+6K)-th ON-control pulses N1, N7 and N13 of the first clock control signal CPV2_ON, and OFF-periods of the first clock signal CK1 sequentially start in response to (1+6K)-th OFF-control pulses F1 and F7 of the second clock control signal CPV2_OFF ('K' is a natural number as 0, 1, 2, 3, . . . ).

The first clock signal CK1 is applied to (1+6K)-th shift registers SRC1 and SRC7 and controls ON-periods of (1+6K)-th gate signals G1_OUT and G7_OUT generated from the (1+6K)-th shift registers SRC1 and SRC7. The (1+6K)-th gate signals G1_OUT and G7_OUT are synchronized with the ON-periods of the first clock signal CK1.

ON-periods of the second clock signal CK2 sequentially start in response to (2+6K)-th ON-control pulses N2 and N8 of the first clock control signal CPV2_ON, and OFF-periods of the second clock signal CK2 sequentially start in response to (2+6K)-th OFF-control pulses F2 and F8 of the second clock control signal CPV2_OFF ('K' is a natural number as 0, 1, 2, 3, . . . ).

The second clock signal CK2 is applied to (2+6K)-th shift registers SRC2 and SRC8 and controls ON-periods of (2+6K)-th gate signals G2_OUT and G8_OUT generated from the (2+6K)-th shift registers SRC2 and SRC8. The (2+6K)-th gate signals G2_OUT and G8_OUT are synchronized with the ON-periods of the second clock signal CK2.

ON-periods of the third clock signal CK3 sequentially start in response to (3+6K)-th ON-control pulses N3 and N9 of the first clock control signal CPV2_ON, and OFF-periods of the third clock signal CK3 sequentially start in response to (3+6K)-th OFF-control pulses F3 and F9 of the second clock control signal CPV2_OFF ('K' is a natural number as 0, 1, 2, 3, . . . ).

The third clock signal CK3 is applied to (3+6K)-th shift registers SRC3 and SRC9 and controls ON-periods of (3+6K)-th gate signals G3_OUT and G9_OUT generated from the (3+6K)-th shift registers SRC3 and SRC9. The (3+6K)-th gate signals G3_OUT and G9_OUT are synchronized with the ON-periods of the third clock signal CK3.

ON-periods of the fourth clock signal CKB1 sequentially start in response to (4+6K)-th ON-control pulses N4 and N10 of the first clock control signal CPV2_ON, and OFF-periods of the fourth clock signal CKB1 sequentially start in response to (4+6K)-th OFF-control pulses F4 and F10 of the second clock control signal CPV2_OFF ('K' is a natural number as 0, 1, 2, 3, . . . ).

The fourth clock signal CKB1 is applied to (4+6K)-th shift registers SRC4 and SRC10 and controls ON-periods of (4+6K)-th gate signals G4_OUT and G10_OUT generated from the (4+6K)-th shift registers SRC4 and SRC10. The (4+6K)-th gate signals G4_OUT and G10_OUT are synchronized with the ON-periods of the fourth clock signal CKB1.

ON-periods of the fifth clock signal CKB2 sequentially start in response to (5+6K)-th ON-control pulses N5 and N11 of the first clock control signal CPV2_ON, and OFF-periods of the fourth clock signal CKB2 sequentially start in response to (5+6K)-th OFF-control pulses F5 and F11 of the second clock control signal CPV2_OFF ('K' is a natural number as 0, 1, 2, 3, . . . ).

The fifth clock signal CKB2 is applied to (5+6K)-th shift register SRC5 and SRC11 and controls ON-periods of (5+6K)-th gate signals G5_OUT and G11_OUT generated from the (5+6K)-th shift registers SRC5 and SRC11. The (5+6K)-th gate signals G5_OUT and G11_OUT are synchronized with the ON-periods of the fifth clock signal CKB2.

ON-periods of the sixth clock signal CKB3 sequentially start in response to (6+6K)-th ON-control pulses N6 and N12 of the first clock control signal CPV2_ON, and OFF-periods of the sixth clock signal CKB3 sequentially start in response to (6+6K)-th OFF-control pulses F6 and F12 of the second clock control signal CPV2_OFF ('K' is a natural number as 0, 1, 2, 3, . . . ).

The sixth clock signal CKB3 is applied to (6+6K)-th shift registers SRC6 and SRC12 and controls ON-periods of (6+6K)-th gate signals G6_OUT and G12_OUT generated from the (6+6K)-th shift registers SRC6 and SRC12. The (6+6K)-th gate signals G6_OUT and G12_OUT are synchronized with the ON-periods of the sixth clock signal CKB3.

According to the exemplary embodiment, six clock signals CK1, CK2, CK3, CKB1, CKB2 and CKB3 are generated based on two clock control signals CPV2_ON and CPV2_OFF. Therefore, a number of pins transmitting signals from the timing controller 200 to the gate clock generator 300 may be decreased.

Figure 13:
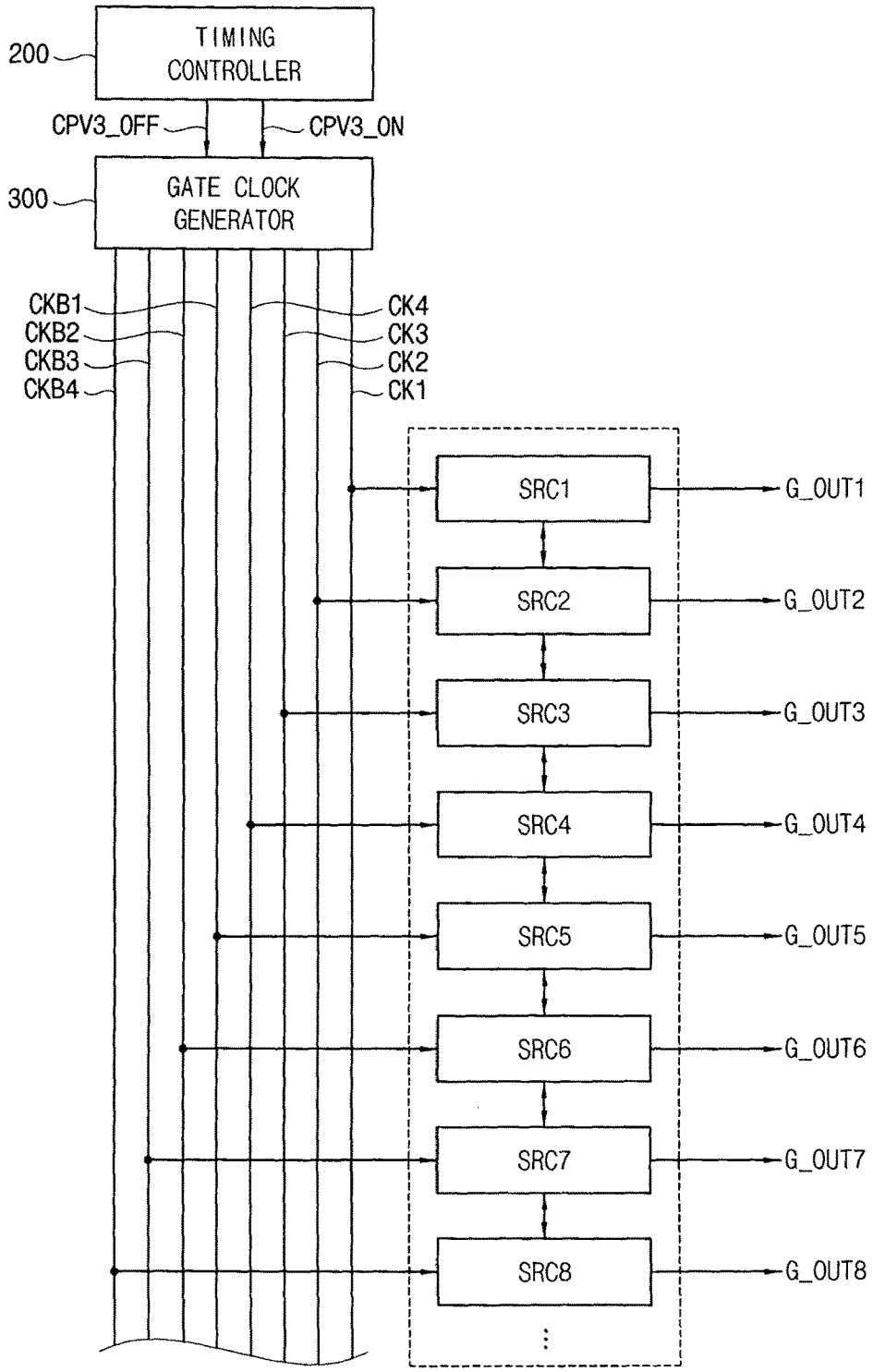
FIG. 13 is a block diagram illustrating a gate driver according to an exemplary embodiment of the inventive concept.
Figure 14:
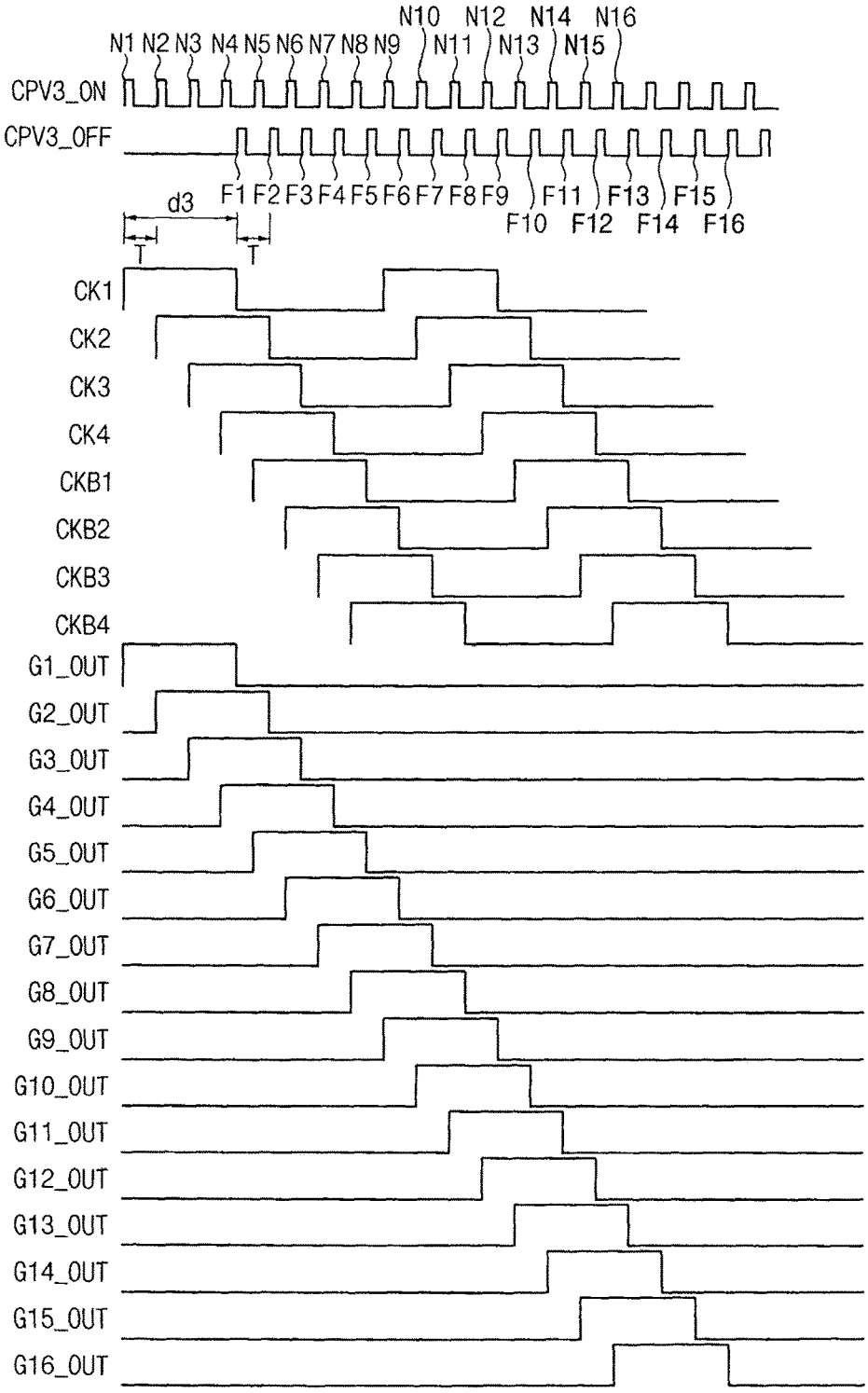
FIG. 14 is a waveform diagram illustrating a driving signal for the gate driver of FIG. 13 according to an exemplary embodiment of the inventive concept.

FIG. 13 is a block diagram illustrating a gate driver according to an exemplary embodiment of the inventive concept. FIG. 14 is a waveform diagram illustrating a driving signal for the gate driver of FIG. 13 according to an exemplary embodiment of the inventive concept.

Referring to FIGS. 13 and 14, the timing controller 200 is configured to output a first clock control signal CPV3_ON and a second clock control signal CVP3_OFF.

The first clock control signal CPV3_ON may include a plurality of ON-control pulses N1, N2, N3, . . . , N16 and the second clock control signal CVP3_OFF may include a plurality of OFF-control pulses F1, F2, F3, . . . , F16. The plurality of ON-control pulses N1, N2, N3, . . . , N16 include a pulse that repeats each time a first period T elapses and the plurality of OFF-control pulses F1, F2, F3, . . . , F16 include a pulse that repeats each time the first period T elapses. The first OFF-control pulse F1 is located between a fourth ON-control pulse N4 and a fifth ON-control pulse N5 and is delayed by a third delay difference d3 from a first ON-control pulse N1.

According to the exemplary embodiment, the gate clock generator 300 is configured to generate a first clock signal CK1, a second clock signal CK2, a third clock signal CK3, a fourth clock signal CK4, a fifth clock signal CKB1, a sixth clock signal CKB2, a seventh clock signal CKB3 and an eighth clock signal CKB4 based on the first and second clock control signals CPV3_ON and CVP3_OFF.

ON-periods of the first clock signal CK1 sequentially start in response to (1+8K)-th ON-control pulses N1, N9 and N17 of the first clock control signal CPV3_ON, and OFF-periods of the first clock signal CK1 sequentially start in response to (1+8K)-th OFF-control pulses F1 and F9 of the second clock control signal CPV3_OFF ('K' is a natural number as 0, 1, 2, 3, . . . ).

The first clock signal CK1 is applied to (1+8K)-th shift registers SRC1 and SRC9 and controls ON-periods of (1+8K)-th gate signals G1_OUT and G9_OUT generated from the (1+8K)-th shift registers SRC1 and SRC9. The (1+8K)-th gate signals G1_OUT and G9_OUT are synchronized with the ON-periods of the first clock signal CK1.

ON-periods of the second clock signal CK2 sequentially start in response to (2+8K)-th ON-control pulses N2 and N10 of the first clock control signal CPV3_ON, and OFF-periods of the second clock signal CK2 sequentially start in response to (2+8K)-th OFF-control pulses F2 and F10 of the second clock control signal CPV3_OFF ('K' is a natural number as 0, 1, 2, 3, . . . ).

The second clock signal CK2 is applied to (2+8K)-th shift registers SRC2 and SRC10 and controls ON-periods of (2+8K)-th gate signals G2_OUT and G10_OUT generated from the (2+8K)-th shift registers SRC2 and SRC10. The (2+8K)-th gate signals G2_OUT and G10_OUT are synchronized with the ON-periods of the second clock signal CK2.

ON-periods of the third clock signal CK3 sequentially start in response to (3+8K)-th ON-control pulses N3 and N11 of the first clock control signal CPV3_ON, and OFF-periods of the third clock signal CK3 sequentially start in response to (3+8K)-th OFF-control pulses F3 and F11 of the second clock control signal CPV3_OFF ('K' is a natural number as 0, 1, 2, 3, . . . ).

The third clock signal CK3 is applied to (3+8K)-th shift registers SRC3 and SRC11 and controls ON-periods of (3+8K)-th gate signals G3_OUT and G11_OUT generated from the (3+8K)-th shift registers SRC3 and SRC11. The (3+8K)-th gate signals G3_OUT and G11_OUT are synchronized with the ON-periods of the third clock signal CK3.

ON-periods of the fourth clock signal CK4 sequentially start in response to (4+8K)-th ON-control pulses N4 and N12 of the first clock control signal CPV3_ON, and OFF-periods of the fourth clock signal CK4 sequentially start in response to (4+8K)-th OFF-control pulses F4 and F12 of the second clock control signal CPV3_OFF ('K' is a natural number as 0, 1, 2, 3, . . . ).

The fourth clock signal CK4 is applied to (4+8K)-th shift registers SRC4 and SRC12 and controls ON-periods of (4+8K)-th gate signals G4_OUT and G12_OUT generated from the (4+8K)-th shift registers SRC4 and SRC12. The (4+8K)-th gate signals G4_OUT and G12_OUT are synchronized with the ON-periods of the fourth clock signal CK4.

ON-periods of the fifth clock signal CKB1 sequentially start in response to (5+8K)-th ON-control pulses N5 and N13 of the first clock control signal CPV3_ON, and OFF-periods of the fifth clock signal CKB1 sequentially start in response to (5+8K)-th OFF-control pulses F5 and F13 of the second clock control signal CPV3_OFF ('K' is a natural number as 0, 1, 2, 3, . . . ).

The fifth clock signal CKB1 is applied to (5+8K)-th shift registers SRC5 and SRC13 and controls ON-periods of (5+8K)-th gate signals G5_OUT and G13_OUT generated from the (5+8K)-th shift registers SRC5 and SRC13. The (5+8K)-th gate signals G5_OUT and G13_OUT are synchronized with the ON-periods of the fifth clock signal CKB1.

ON-periods of the sixth clock signal CKB2 sequentially start in response to (6+8K)-th ON-control pulses N6 and N14 of the first clock control signal CPV3_ON, and OFF-periods of the sixth clock signal CKB2 sequentially start in response to (6+8K)-th OFF-control pulses F6 and F14 of the second clock control signal CPV3_OFF ('K' is a natural number as 0, 1, 2, 3, . . . ).

The sixth clock signal CKB2 is applied to (6+8K)-th shift registers SRC6 and SRC14 and controls ON-periods of (6+8K)-th gate signals G6_OUT and G14_OUT generated from the (6+8K)-th shift registers SRC6 and SRC14. The (6+8K)-th gate signals G6_OUT and G14_OUT are synchronized with the ON-periods of the sixth clock signal CKB2.

ON-periods of the seventh clock signal CKB3 sequentially start in response to (7+8K)-th ON-control pulses N7 and N15 of the first clock control signal CPV3_ON, and OFF-periods of the seventh clock signal CKB3 sequentially start in response to (7+8K)-th OFF-control pulses F7 and F15 of the second clock control signal CPV3_OFF ('K' is a natural number as 0, 1, 2, 3, . . . ).

The seventh clock signal CKB3 is applied to (7+8K)-th shift registers SRC7 and SRC15 and controls ON-periods of (7+8K)-th gate signals G7_OUT and G15_OUT generated from the (7+8K)-th shift registers SRC7 and SRC15. The (7+8K)-th gate signals G7_OUT and G15_OUT are synchronized with the ON-periods of the seventh clock signal CKB3.

ON-periods of the eighth clock signal CKB4 sequentially start in response to (8+8K)-th ON-control pulses N8 and N16 of the first clock control signal CPV3_ON, and OFF-periods of eighth clock signal CKB4 sequentially start in response to (8+8K)-th OFF-control pulses F8 and F16 of the second clock control signal CPV3_OFF ('K' is a natural number as 0, 1, 2, 3, . . . ).

The eighth clock signal CKB4 is applied to (8+8K)-th shift registers SRC8 and SRC16 and controls ON-periods of (8+8K)-th gate signals G8_OUT and G16_OUT generated from the (8+8K)-th shift registers SRC8 and SRC16. The (8+8K)-th gate signals G8_OUT and G16_OUT are synchronized with the ON-periods of the eighth clock signal CKB4.

A circuit including the timing controller 200, the gate clock generator 300, and the gate driver 400 may be referred to as a display apparatus driving circuit.

According to the exemplary embodiment, eight clock signals CK1, CK2, CK3, CK4, CKB1, CKB2, CKB3 and CKB4 are generated based on two clock control signals CPV3_ON and CPV3_OFF. Therefore, a number of pins transmitting signals from the timing controller 200 to the gate clock generator 300 may be decreased.

According to exemplary embodiments of the inventive concept, four or more clock signals may be generated based on one or two clock control signals. Therefore, a number of pins transmitting signals from the timing controller to the gate clock generator may be decreased.

Although a few exemplary embodiments of the inventive concept have been described, those skilled in the art will readily appreciate that many modifications are possible in the exemplary embodiments without materially departing from the inventive concept. Accordingly, all such modifications are intended to be included within the scope of the inventive concept.

What is claimed is:

1. A display apparatus comprising:

a timing controller configured to generate a single clock control signal comprising a plurality of ON-control pulses and a plurality of OFF-control pulses;

a gate clock generator configured to generate a plurality of clock signals based on the single clock control signal, wherein ON-periods of the plurality of clock signals start in response to an ON-control pulse among the ON-control pulses and OFF-periods of the plurality of clock signals start in response to an OFF-control pulse among the OFF-control pulses;

a gate driver comprising a plurality of shift registers, wherein the shift registers generate a plurality of gate signals based on the plurality of clock signals; and a display panel comprising a display area in which a plurality of pixels is arranged and a peripheral area in which the plurality of shift registers is arranged, wherein the plurality of ON-control pulses includes a pulse that repeats each time a period has elapsed and the plurality of OFF-control pulses include a pulse that repeats each time the period has elapsed, and wherein a pulse of the OFF-control pulses is delayed from a pulse of the ON-control pulses by less than the period.

2. The display apparatus of claim 1, wherein a first OFF-control pulse of the plurality of OFF-control pulses has a delay difference from a first ON-control pulse of the plurality of ON-control pulses, and the delay difference is greater than the period and less than two times the period.

3. The display apparatus of claim 2, wherein the plurality of clock signals includes a first clock signal, a second clock signal which is delayed by the period from the first clock signal, a third clock signal which is delayed by the period from the second clock signal and a fourth clock signal which is delayed by the period from the third clock signal.

4. The display apparatus of claim 3, wherein the first clock signal is applied to a (1+4K)-th shift register among the plurality of shift registers, the (1+4K)-th shift register is configured to output a (1+4K)-th gate signal among the plurality of gate signals synchronized with an ON-period of the first clock signal, the second clock signal is applied to a (2+4K)-th shift register among the plurality of shift registers, the (2+4K)-th shift register is configured to output a (2+4K)-th gate signal among the plurality of gate signals synchronized with an ON-period of the second clock signal, the third clock signal is applied to a (3+4K)-th shift register among the plurality of shift registers, the (3+4K)-th shift register is configured to output a (3+4K)-th gate signal among the plurality of gate signals synchronized with an ON-period of the third clock signal, the fourth clock signal is applied to a (4+4K)-th shift register among the plurality of shift registers, and the (4+4K)-th shift register is configured to output a (4+4K)-th gate signal among the plurality of gate signals synchronized with an ON-period of the fourth clock signal, wherein K is a natural number.

5. The display apparatus of claim 1, wherein a first OFF-control pulse of the plurality of OFF-control pulses has a delay difference from a first ON-control pulse of the plurality of ON-control pulses, and the delay difference is greater than three times the period and less than four times the period.

6. The display apparatus of claim 5, wherein the plurality of clock signals include a first clock signal, a second clock signal which is delayed by the period from the first clock signal, a third clock signal which is delayed by the period from the second clock signal, a fourth clock signal which is delayed by the period from the third clock signal, a fifth clock signal which is delayed by the period from the fourth clock signal and a sixth clock signal which is delayed by the period from the fifth clock signal.

7. The display apparatus of claim 6, wherein the first clock signal is applied to a (1+6K)-th shift register among the plurality of shift registers, the (1+6K)-th shift register is configured to output a (1+6K)-th gate signal among the plurality of gate signals synchronized with an ON-period of the first clock signal, the second clock signal is applied to a (2+6K)-th shift register among the plurality of shift registers, the (2+6K)-th shift register is configured to output a (2+6K)-th gate signal among the plurality of gate signals synchronized with an ON-period of the second clock signal, the third clock signal is applied to a (3+6K)-th shift register among the plurality of shift registers, the (3+6K)-th shift register is configured to output a (3+6K)-th gate signal among the plurality of gate signals synchronized with an ON-period of the third clock signal, the fourth clock signal is applied to a (4+6K)-th shift register among the plurality of shift registers, the (4+6K)-th shift register is configured to output a (4+6K)-th gate signal among the plurality of gate signals synchronized with an ON-period of the fourth clock signal, the fifth clock signal is applied to a (5+6K)-th shift register among the plurality of shift registers, the (5+6K)-th shift register is configured to output a (5+6K)-th gate signal among the plurality of gate signals synchronized with an ON-period of the fifth clock signal, the sixth clock signal is applied to a (6+6K)-th shift register among the plurality of shift registers, and the (6+6K)-th shift register is configured to output a (6+6K)-th gate signal among the plurality of gate signals synchronized with an ON-period of the sixth clock signal, wherein K is a natural number.

8. The display apparatus of claim 1, wherein a first OFF-control pulse of the plurality of OFF-control pulses has a delay difference from a first ON-control pulse of the plurality of ON-control pulses, and the difference is greater than four times the period and less than five times the period.

9. The display apparatus of claim 8, wherein the plurality of clock signals include a first clock signal, a second clock signal which is delayed by the period from the first clock signal, a third clock signal which is delayed by the period from the second clock signal, a fourth clock signal which is delayed by the period from the third clock signal, a fifth clock signal which is delayed by the period from the fourth clock signal, a sixth clock signal which is delayed by the period from the fifth clock signal, a seventh clock signal which is delayed by the period from the sixth clock signal and an eighth clock signal which is delayed by the period from the seventh clock signal.

10. The display apparatus of claim 9, wherein the first clock signal is applied to a (1+8K)-th shift register among the plurality of shift registers, the (1+8K)-th shift register is configured to output a (1+8K)-th gate signal among the plurality of gate signals synchronized with an ON-period of the first clock signal, the second clock signal is applied to a (2+8K)-th shift register among the plurality of shift registers, the (2+8K)-th shift register is configured to output a (2+8K)-th gate signal among the plurality of gate signals synchronized with an ON-period of the second clock signal, the third clock signal is applied to a (3+8K)-th shift register among the plurality of shift registers, the (3+8K)-th shift register is configured to output a (3+8K)-th gate signal among the plurality of gate signals synchronized with an ON-period of the third clock signal, the fourth clock signal is applied to a (4+8K)-th shift register among the plurality of shift registers, the (4+8K)-th shift register is configured to output a (4+8K)-th gate signal among the plurality of gate signals synchronized with an ON-period of the fourth clock signal, the fifth clock signal is applied to a (5+8K)-th shift register among the plurality of shift registers, the (5+8K)-th shift register is configured to output a (5+8K)-th gate signal among the plurality of gate signals synchronized with an ON-period of the fifth clock signal, the sixth clock signal is applied to a (6+8K)-th shift register among the plurality of shift registers, the (6+8K)-th shift register is configured to output a (6+8K)-th gate signal among the plurality of gate signals synchronized with an ON-period of the sixth clock signal, the seventh clock signal is applied to a (7+8K)-th shift register among the plurality of shift registers, the (7+8K)-th shift register is configured to output a (7+8K)-th gate signal among the plurality of gate signals synchronized with an ON-period of the sixth clock signal, the eighth clock signal is applied to a (8+8K)-th shift register among the plurality of shift registers, and the (8+8K)-th shift register is configured to output a (8+8K)-th gate signal among the plurality of gate signals synchronized with an ON-period of the sixth clock signal.

11. The display apparatus of claim 1, wherein an m-th shift register of the plurality of shift registers comprises:

a pull-up part configured to output a high voltage of a first clock signal among the plurality of clock signals as a high voltage of an m-th gate signal among the plurality of gate signals;

a control pull-down part configured to discharge a control node of the pull-up part in response to an (m+1)-th gate signal among the plurality of gate signals;

a first control holding part configured to hold the control node of the pull-up part to a low voltage in response to a high voltage of a second clock signal among the plurality of clock signals having a phase opposite to a phase of the first clock signal; and a second control holding part configured to hold an output node of the pull-up part to a low voltage in response to a high voltage of the second clock signal, wherein m is a natural number greater than 0.

12. A display apparatus comprising:

a timing controller configured to generate a first clock control signal comprising a plurality of ON-control pulses and a second clock control signal comprising a plurality of OFF-control pulses;

a gate clock generator configured to generate a plurality of clock signals based on the first clock control signal and the second clock control signal, wherein ON-periods of the plurality of clock signals start in response to an ON-control pulse among the ON-control pulses and OFF-periods of the plurality of clock signals start in response to an OFF-control pulse among the OFF-control pulses;

a gate driver comprising a plurality of shift registers, wherein the shift registers generate a plurality of gate signals based on the plurality of clock signals; and a display panel comprising a display area in which a plurality of pixels is arranged and a peripheral area in which the plurality of shift registers is arranged, wherein the plurality of ON-control pulses include a pulse that repeats each time a period has elapsed, the plurality of OFF-control pulses include a pulse that repeats each time the period has elapsed, and wherein a first OFF-control pulse of the plurality of OFF-control pulses has a delay difference from a first ON-control pulse of the plurality of ON-control pulses, the delay difference is greater than M times the period and less than N times the period, and M and N are positive integers.

13. The display apparatus of claim 12, wherein the delay difference is greater than the period and less than twice the period.

14. The display apparatus of claim 13, wherein a first clock signal among the plurality of clock signals is applied to a (1+4K)-th shift register among the shift registers, the (1+4K)-th shift register is configured to output a (1+4K)-th gate signal among the gate signals synchronized with an ON-period of the first clock signal, a second clock signal among the clock signals is applied to a (2+4K)-th shift register among the shift registers, the (2+4K)-th shift register is configured to output a (2+4K)-th gate signal among the gate signals synchronized with an ON-period of the second clock signal, a third clock signal among the clock signals is applied to a (3+4K)-th shift register among the shift registers, the (3+4K)-th shift register is configured to output a (3+4K)-th gate signal among the gate signals synchronized with an ON-period of the third clock signal, a fourth clock signal among the clock signals is applied to a (4+4K)-th shift register among the shift registers, and the (4+4K)-th shift register is configured to output a (4+4K)-th gate signal among the gate signals synchronized with an ON-period of the fourth clock signal, wherein K is a natural number.

15. The display apparatus of claim 12, wherein the delay difference is greater than three times the period and less than four times the period.

16. The display apparatus of claim 15, wherein the clock signals include a first clock signal, a second clock signal which is delayed by the period from the first clock signal, a third clock signal which is delayed by the period from the second clock signal, a fourth clock signal which is delayed by the period from the third clock signal, a fifth clock signal which is delayed by the period from the fourth clock signal and a sixth clock signal which is delayed by the period from the fifth clock signal, wherein the first clock signal is applied to a (1+6K)-th shift register among the shift registers, the (1+6K)-th shift register is configured to output a (1+6K)-th gate signal synchronized among the gate signals with an ON-period of the first clock signal, the second clock signal is applied to a (2+6K)-th shift register among the shift registers, the (2+6K)-th shift register is configured to output a (2+6K)-th gate signal among the gate signals synchronized with an ON-period of the second clock signal, the third clock signal is applied to a (3+6K)-th shift register among the shift registers, the (3+6K)-th shift register is configured to output a (3+6K)-th gate signal among the gate signals synchronized with an ON-period of the third clock signal, the fourth clock signal is applied to a (4+6K)-th shift register among the shift registers, the (4+6K)-th shift register is configured to output a (4+6K)-th gate signal among the gate signals synchronized with an ON-period of the fourth clock signal, the fifth clock signal is applied to a (5+6K)-th shift register among the shift registers, the (5+6K)-th shift register is configured to output a (5+6K)-th gate signal among the gate signals synchronized with an ON-period of the fifth clock signal, the sixth clock signal is applied to a (6+6K)-th shift register among the shift registers, and the (6+6K)-th shift register is configured to output a (6+6K)-th gate signal among the gate signals synchronized with an ON-period of the sixth clock signal, wherein K is natural number.

17. The display apparatus of claim 12, wherein the delay difference is greater than four times the period and less than five times the period.

18. The display apparatus of claim 17, wherein the clock signals include a first clock signal, a second clock signal which is delayed by the period from the first clock signal, a third clock signal which is delayed by the period from the second clock signal, a fourth clock signal which is delayed by the period from the third clock signal, a fifth clock signal which is delayed by the period from the fourth clock signal, a sixth clock signal which is delayed by the period from the fifth clock signal, a seventh clock signal which is delayed by the period from the sixth clock signal and an eighth clock signal which is delayed by the period from the seventh clock signal, wherein the first clock signal is applied to a (1+8K)-th shift register among the shift registers, the (1+8K)-th shift register is configured to output a (1+8K)-th gate signal among the gate signals synchronized with an ON-period of the first clock signal, the second clock signal is applied to a (2+8K)-th shift register among the shift registers, the (2+8K)-th shift register is configured to output a (2+8K)-th gate signal among the gate signals synchronized with an ON-period of the second clock signal, the third clock signal is applied to a (3+8K)-th shift register among the shift registers, the (3+8K)-th shift register is configured to output a (3+8K)-th gate signal among the gate signals synchronized with an ON-period of the third clock signal, the fourth clock signal is applied to a (4+8K)-th shift register among the shift registers, the (4+8K)-th shift register is configured to output a (4+8K)-th gate signal among the gate signals synchronized with an ON-period of the fourth clock signal, the fifth clock signal is applied to a (5+8K)-th shift register among the shift registers, the (5+8K)-th shift register is configured to output a (5+8K)-th gate signal among the gate signals synchronized with an ON-period of the fifth clock signal, the sixth clock signal is applied to a (6+8K)-th shift register among the shift registers, the (6+8K)-th shift register is configured to output a (6+8K)-th gate signal among the gate signals synchronized with an ON-period of the sixth clock signal, the seventh clock signal is applied to a (7+8K)-th shift register among the shift registers, the (7+8K)-th shift register is configured to output a (7+8K)-th gate signal among the gate signals synchronized with an ON-period of the sixth clock signal, the eighth clock signal is applied to a (8+8K)-th shift register among the shift registers, and the (8+8K)-th shift register is configured to output a (8+8K)-th gate signal among the gate signals synchronized with an ON-period of the sixth clock signal, wherein K is a natural number.

19. The display apparatus of claim 12, wherein an m-th shift register of the plurality of shift registers comprises:

a pull-up part configured to output a high voltage of a first clock signal among the clock signals as a high voltage of an m-th gate signal among the gate signals;

a control pull-down part configured to discharge a control node of the pull-up part in response to an (m+1)-th gate signal among the gate signals;

a first control holding part configured to hold the control node of the pull-up part to a low voltage in response to a high voltage of a second clock signal among the clock signals having a phase opposite to a phase of the first clock signal; and a second control holding part configured to hold an output node of the pull-up part to a low voltage in response to a high voltage of the second clock signal, wherein m is a natural number greater than 0.

* * * * *